US009415601B1

(12) United States Patent
Tsukida

(10) Patent No.: US 9,415,601 B1
(45) Date of Patent: Aug. 16, 2016

(54) PRINTING APPARATUS

(71) Applicant: SEIKO EPSON CORPORATION, Tokyo (JP)

(72) Inventor: Masaki Tsukida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/980,126

(22) Filed: Dec. 28, 2015

(30) Foreign Application Priority Data

Mar. 27, 2015 (JP) ..... 2015-065933

(51) Int. Cl.
*B41J 29/393* (2006.01)
*B41J 2/175* (2006.01)

(52) U.S. Cl.
CPC ..... *B41J 2/17566* (2013.01)

(58) Field of Classification Search
CPC ..... B41J 2/17566; B41J 2002/17566; B41J 2/17513
See application file for complete search history.

(56) References Cited

U.S. PATENT DOCUMENTS 8,919,900 B2 * 12/2014 Yamagata ..... B41J 2/17566 347/19
8,950,852 B2 * 2/2015 Shimizu ..... B41J 2/17596 347/84
9,308,735 B2 * 4/2016 Nozawa ..... B41J 2/17553
2010/0254202 A1 10/2010 Asauchi
2013/0321505 A1 12/2013 Nishihara

FOREIGN PATENT DOCUMENTS

JP 2010-257446 A 11/2010
JP 2013-248789 A 12/2013

* cited by examiner

*Primary Examiner* — Lamson Nguyen
(74) *Attorney, Agent, or Firm* — Global IP Counselors, LLP

(57) ABSTRACT

A printer 110 to which an ink tank 11 for containing ink IK is fixed and configured such that a user can supply the ink IK to the ink tank 11 includes a sensor 60 for performing remaining ink detection for checking whether or not the ink IK is present at a predetermined position in the ink tank 11, a control unit 40 that executes the remaining ink detection using the sensor 60, a consumption calculation unit 42 that calculates consumption of the ink IK that is consumed from the ink tank 11, and a storage unit 50 that updates and stores the consumption of the ink IK calculated by the consumption calculation unit 42. When a print job is being executed, the control unit 40 executes the remaining ink detection after a first predetermined amount of the ink IK is consumed.

13 Claims, 8 Drawing Sheets

PRINTING APPARATUS

BACKGROUND

1. Technical Field

The present invention relates to printing apparatuses.

2. Related Art

Inkjet printers (hereinafter referred to simply as "printers") are known as an example of printing apparatuses. In a printer, ink, which serves as an example of liquid, is contained in an ink cartridge, which is an example of a liquid vessel, and printing can be performed by ejecting ink from an ejection head to a print medium such as printing paper. In this kind of printer, a printer has been proposed that has a function of detecting a decrease in the amount of remaining ink in an ink tank and providing a warning in order to avoid an idle-ejecting state, which is a state where the ink has been consumed and the ink to be ejected has run out (e.g., see JP-A-2013-248789 and JP-A-2010-257446).

The printer described in JP-A-2013-248789 has a configuration in which a prism that reflects light in accordance with the state of remaining ink is provided in an ink cartridge, and a decrease in the remaining ink in the ink cartridge is detected based on a detection signal obtained by receiving reflected light from the prism using a photosensor. Remaining ink detection is executed for every single path, i.e., every time the ink cartridge passes over the photosensor.

The printer described in JP-A-2010-257446 has a configuration in which a piezoelectric sensor, in which the frequency of residual vibration of a diaphragm varies in accordance with the state of remaining ink, is provided in an ink cartridge, and a decrease in the amount of remaining ink in the ink cartridge is detected based on a response signal having the frequency of the residual vibration of the diaphragm. If a decrease in the amount of remaining ink (ink-low) is detected, thereafter the detection of the amount of remaining ink using the sensor is not executed, and the amount of remaining ink is determined by a count value obtained by counting the amount of used ink in a pseudo manner.

The printers described in JP-A-2013-248789 and JPA-2010-257446 assume that an ink cartridge is replaced with a new ink cartridge when the ink has run out, whereas a configuration is not considered in which a user can supply ink to an ink tank fixed to the printers. In the case of the configuration in which the user supplies ink to the ink tank, the initial amount of ink in the ink tank is not always fixed due to the user supplying the ink before the printers provide a warning that the ink has run out, or the amount of the ink supplied by the user varying, for example. For this reason, the printers having a configuration in which the user supplies ink to the ink tank is required to more reliably detect a decrease in the amount of remaining ink, in order to avoid the idle-ejecting state.

Meanwhile, for example, in the case where a sensor for detecting a decrease in the amount of remaining ink is configured to apply a voltage to a pair of electrodes provided in an ink tank and detect a decrease in the amount of remaining ink based on a resistance value between the pair of electrodes, if the detection of the remaining ink is frequently executed and the time for which the voltage is applied to the ink is prolonged, there is concern that the ink is affected thereby, e.g., deposition of the ink occurs. In addition, in the case of executing the remaining ink detection at the time of non-printing, i.e., when the ink is not discharged from a print head, if the remaining ink detection is frequently executed, there is concern that the throughput in printing degrades.

SUMMARY

The invention has been made in order to solve at least a part of the foregoing problem, and can be achieved as the following modes or application examples.

Application Example 1

A printing apparatus in this application example is a printing apparatus to which a liquid vessel for containing liquid is fixed, and configured such that a user can supply the liquid to the liquid vessel, including: a sensor for performing remaining liquid detection for checking whether or not the liquid is present at a predetermined position in the liquid vessel; a control unit that executes the remaining liquid detection using the sensor; a consumption calculation unit that calculates consumption of the liquid that is consumed from the liquid vessel; and a storage unit that updates and stores the consumption of the liquid calculated by the consumption calculation unit, wherein, when a print job is being executed, the control unit executes the remaining liquid detection after a first predetermined amount of the liquid is consumed.

With the configuration in this application example, the printing apparatus configured such that the user can supply the liquid to the fixed liquid vessel includes the sensor for performing the remaining liquid detection for checking whether or not the liquid is present at the predetermined position in the liquid vessel, and the control unit executes the remaining liquid detection using the sensor every time the consumption of the liquid calculated by the consumption calculation unit reaches the first predetermined amount. Accordingly, regardless of the timing of the user supplying the liquid to the liquid vessel or the amount of the liquid to be supplied, if the first predetermined amount of the liquid has been consumed and the liquid is no longer present at the predetermined position in the liquid vessel, a decrease in the amount of the remaining liquid can be reliably detected before the liquid is consumed next. Accordingly, the risk of occurrence of idle ejection can be suppressed. In addition, since the remaining liquid detection is not performed until the consumption of the liquid reaches the first predetermined amount, it is possible to suppress the influence on the liquid that may lead to deposition of the liquid or the like, and degradation in the throughput in printing.

Application Example 2

In the printing apparatus according to the above application example, it is preferable that the control unit executes the remaining liquid detection when in a non-printing state while the print job is being executed.

With the configuration in this application example, the remaining liquid detection is executed when in a non-printing state while a print job is being executed, e.g., after a print job instruction is given until printing is started, or when printing ends and the paper is discharged. Accordingly, a decrease in the amount of the remaining liquid can also be reliably detected without degrading the throughput in printing even while a print job is being executed.

Application Example 3

In the printing apparatus according to the above application example, it is preferable that the sensor includes a pair of conductive members, and detects whether or not the liquid remains based on a resistance value between the pair of conductive members.

With the configuration in this application example, it is detected whether or not the liquid is present at the predetermined position in the liquid vessel, based on the resistance value between the pair of conductive members. For this reason, if the amount of the remaining liquid decreases and the conductive members are no longer soaked in the liquid, the resistance value between the pair of conductive members increases (e.g., becomes infinite), and accordingly, a decrease in the amount of the remaining liquid can be reliably detected.

Application Example 4

In the printing apparatus according to the above application example, it is preferable that the storage unit has an area for storing a sensor-end flag that is set when the remaining liquid detection is executed and it is detected that the liquid does not remain, and the control unit stops execution of the remaining liquid detection if the sensor-end flag is stored in the storage unit.

With the configuration in this application example, the control unit does not execute the remaining liquid detection if the sensor-end flag is stored in the storage unit, i.e., if it is once detected that the liquid does not remain. If the remaining liquid detection is executed immediately after detecting for the first time that the liquid does not remain, there is concern that the result of the remaining liquid detection changes and confuses the user, or it is erroneously detected that the liquid is present at the predetermined position even though the liquid is actually not present thereat, resulting in occurrence of idle ejection, in the case where the liquid vessel (printing apparatus) tilts and the liquid surface moves or where air bubbles are generated in the liquid in the liquid vessel, for example. Therefore, erroneous detection that may lead to a change of the detection result which confuses the user or occurrence of idle ejection can be avoided by stopping execution of the remaining liquid detection after detecting that the liquid does not remain.

Application Example 5

In the printing apparatus according to the above application example, it is preferable that a plurality of the liquid vessels are provided, the sensor is configured to be able to individually detect whether or not the liquid remains in the plurality of liquid vessels, the storage unit has an area for individually storing the sensor-end flag for the plurality of liquid vessels, and the control unit stops execution of the remaining liquid detection for a liquid vessel for which the sensor-end flag is stored in the storage unit among the plurality of liquid vessels.

With the configuration in this application example, in the printing apparatus having the plurality of liquid vessels, the remaining liquid detection is not executed for the liquid vessel for which the sensor-end flag is stored in the storage unit among the plurality of liquid vessels. For this reason, when the printing apparatus has the plurality of liquid vessels, execution of the remaining liquid detection is stopped for the liquid vessel in which it is once detected that the liquid does not remain. Thereby, erroneous detection that may lead to a change of the detection result which confuses the user or occurrence of idle ejection can be avoided. For the liquid vessel in which it has not yet been detected that the liquid does not remain among the plurality of liquid vessels, the remaining liquid detection is executed every time the first predetermined amount of the liquid is consumed, and a decrease in the amount of the remaining liquid can be detected.

Application Example 6

In the printing apparatus according to the above application example, it is preferable that, when the print job is not being executed, the control unit executes the remaining liquid detection at a predetermined timing for a liquid vessel for which the storage unit does not store the sensor-end flag among the plurality of liquid vessels.

With the configuration according to this application example, when a print job is not being executed, the remaining liquid detection is executed for the liquid vessel for which the storage unit does not store the sensor-end flag. Accordingly, for the liquid vessel in which it has not yet been detected that the liquid does not remain, a decrease in the amount of the remaining liquid can be reliably detected before executing the next print job by executing the remaining liquid detection at the predetermined timing, e.g., when turning on the power (ON), before a print job instruction is given, when in a standby state after executing a print job, or when cleaning the head. Therefore, the risk of occurrence of idle ejection can be further suppressed.

Application Example 7

In the printing apparatus according to the above application example, it is preferable that, if the sensor-end flag is stored in the storage unit, the control unit executes the remaining liquid detection after consumption of the liquid becomes larger than or equal to a second predetermined amount, the consumption of the liquid being calculated starting from the time when it is detected for the last time that the liquid remains before the remaining liquid detection is executed and it is detected that the liquid does not remain.

With the configuration in this application example, for the liquid vessel in which it is detected that the liquid does not remain, the remaining liquid detection is executed after the consumption of the liquid becomes larger than or equal to the second predetermined amount, the consumption of the liquid being calculated starting from the time when it is detected for the last time that the liquid remains before it is detected that the liquid does not remain. If the remaining liquid detection is executed after a certain amount of the liquid has been consumed since it was detected for the first time that the liquid did not remain, a change of the detection result and erroneous detection hardly occur even if the liquid surface moves or air bubbles are generated. Then, execution of the remaining liquid detection is resumed after the consumption of the liquid becomes larger than or equal to the second predetermined amount. If it is detected as a result of the remaining liquid detection that the liquid does not remain, a decrease in the amount of the remaining liquid can be checked, and it can be checked that the user has supplied the liquid if it is detected that the liquid remains. In addition, since the consumption of the liquid calculated starting from the time when it is detected for the last time that the liquid remains is compared with the second predetermined amount, the risk can be reduced that the amount of the liquid that has actually been consumed since it was detected for the first time that the liquid did not remain becomes larger than the consumption calculated by the consumption calculation unit. It is thereby possible to suppress the risk of occurrence of idle ejection.

Application Example 8

In the printing apparatus according to the above application example, it is preferable that, after executing the remaining liquid detection and detecting that the liquid does not remain after the consumption of the liquid becomes larger than or equal to the second predetermined amount, the control unit executes the remaining liquid detection once per print job when the print job is being executed, and executes the remaining liquid detection at a predetermined timing when the print job is not being executed.

With the configuration in this application example, execution of the remaining liquid detection is resumed after the consumption of the liquid becomes larger than or equal to the second predetermined amount, and the remaining liquid detection is also executed after it is detected that the liquid does not remain. Thereby, it can also be checked when the user has supplied the liquid. Here, it is conceivable that the user often supplies the liquid when a print job is not being executed, and does not often supply the liquid when a print job is being executed. Accordingly, when a print job is being executed, the remaining liquid detection is executed only once before the print job is started, for example, and when a print job is not being executed, the remaining liquid detection is executed at the predetermined timing. It is thereby possible to detect that the user has supplied the liquid and suppress degradation in throughput in printing, while suppressing the risk of occurrence of idle ejection.

Application Example 9

In the printing apparatus according to the above application example, it is preferable that, when the remaining liquid detection is executed and it is detected that the liquid remains after the consumption of the liquid becomes larger than or equal to the second predetermined amount, the control unit deletes the sensor-end flag stored in the storage unit.

With the configuration in this application example, the remaining liquid detection is executed after the second predetermined amount of the liquid or more has been consumed since it was detected for the first time that the liquid did not remain, and if it is detected that the liquid remains, it can be determined that the user has supplied the liquid while execution of the remaining liquid detection is stopped. Accordingly, by deleting the sensor-end flag in this case, it is possible to prevent erroneous determination that the liquid does not remain from being made even though the liquid remains in the liquid vessel.

Application Example 10

In the printing apparatus according to the above application example, it is preferable that, after the remaining liquid detection is executed and it is detected that the liquid does not remain after the consumption of the liquid becomes larger than or equal to the second predetermined amount, the control unit stops a printing operation after consumption of the liquid becomes larger than or equal to a third predetermined amount that is larger than the second predetermined amount, the consumption of the liquid being calculated starting from the time when it is detected for the last time that the liquid remains.

With the configuration in this application example, the remaining liquid detection is executed after the third predetermined amount, which is larger than the second predetermined amount, of the liquid or more has been consumed since it was detected for the first time that the liquid did not remain, and if it is detected that the liquid does not remain, it can be determined that the amount of the remaining liquid in the liquid vessel has further decreased. Accordingly, occurrence of idle ejection can be suppressed and the user can be prompted to supply the liquid by stopping the printing operation.

Application Example 11

In the printing apparatus according to the above application example, it is preferable that the storage unit updates and stores, for each path, the consumption of the liquid calculated by the consumption calculation unit while the print job is being executed, and the control unit uses the consumption of the liquid stored in the storage unit for comparison with the first predetermined amount, the second predetermined amount, and the third predetermined amount.

With the configuration in this application example, the storage unit updates and stores the consumption of the liquid calculated by the consumption calculation unit for every single path while a print job is being executed. Accordingly, the latest consumption of the liquid can be recognized. In addition, since the control unit uses the latest consumption of the liquid for comparison with the first predetermined amount, the second predetermined amount, and the third predetermined amount, management of the amount of the remaining liquid can be more accurately performed.

Application Example 12

In the printing apparatus according to the above application example, it is preferable that the sensor has an AC voltage generation circuit that generates an AC voltage, a detection unit that detects whether or not the liquid remains, the pair of conductive members that are separately disposed in each of the plurality of liquid vessels, and a selection circuit that selectively connects the pair of conductive members disposed in one of the plurality of liquid vessels to the AC voltage generation circuit and the detection unit, and the control unit transmits, to the selection circuit, a selection signal for selecting a liquid vessel for which the remaining liquid detection is to be executed from among the plurality of liquid vessels, and transmits an instruction signal for giving an instruction to generate an AC voltage to the AC voltage generation circuit.

With the configuration in this application example, regarding the plurality of liquid vessels in each of which a pair of conductive members are separately disposed, the selection circuit connects a pair of conductive members disposed in one of the liquid vessels to the AC voltage generation circuit based on the selection signal from the control unit, and an AC voltage is applied to the selected pair of conductive members from the AC voltage generation circuit based on the instruction signal from the control unit. Then, it can be detected whether or not the liquid remains in the selected liquid vessel, by detecting a detection signal from the selected pair of conductive members using the detection unit connected by the selection circuit. Thus, the remaining liquid detection for the plurality of liquid vessels can be performed using a single AC voltage generation circuit and a single detection unit, and accordingly, the configuration of the sensor can be simplified. As a result, the size and the manufacturing costs of the printing apparatus can be suppressed. Furthermore, since an AC voltage is applied to the liquid, the influence that may lead to deposition of the liquid can be suppressed, compared with the case where a DC voltage is applied.

Application Example 13

In the printing apparatus according to the above application example, it is preferable that, regarding at least two of the plurality of liquid vessels, the amounts of the remaining liquid therein at the time when the remaining liquid detection is executed and it is detected that the liquid does not remain are different from each other, and the first predetermined amount for each of the two of the liquid vessels is set to a different value.

With the configuration in this application example, regarding at least two of the plurality of liquid vessels, the amounts of the remaining liquid therein at the time when it is detected that the liquid does not remain are different from each other, and the first predetermined amount is set to a different value for each of these liquid vessels. For example, in the case where the consumption is different depending on the type of the liquid, a larger amount of the remaining liquid at the time when it is detected that the liquid does not remain can be set for the liquid whose consumption is larger than for the liquid whose consumption is smaller. Similarly, regarding the first predetermined amount that serves as a reference of the consumption of the liquid at the time of executing the remaining liquid detection, a larger first predetermined amount can be set for the liquid whose consumption is larger, than for the liquid whose consumption is smaller. Accordingly, it is possible to reliably detect a decrease in the amount of the remaining liquid and suppress the risk of occurrence of idle ejection, in accordance with the consumption of the liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

The following describes an embodiment of the invention with reference to the drawings. The drawings used are enlarged, shrunk, or exaggerated as appropriate such that described parts can be recognized. Parts other than constituent elements necessary for description are omitted in some cases.

Basic Configuration of Printer System

Figure 1:
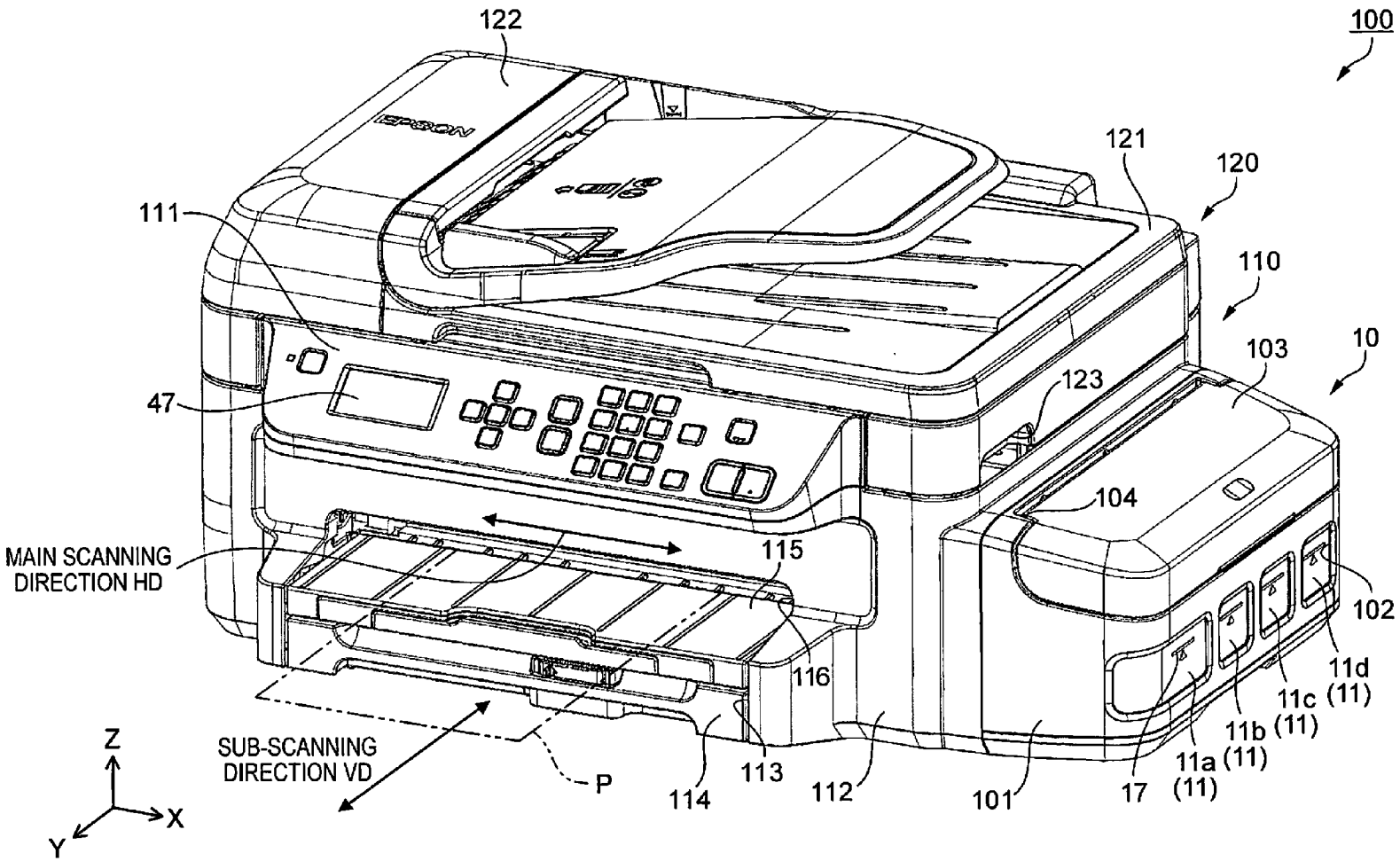
FIG. 1 is a perspective view showing a basic configuration of a printer system according to the present embodiment.

A description will be given, with reference to FIG. 1, of a basic configuration of a printer system including an inkjet printer (hereinafter referred to simply as a printer), which serves as a printing apparatus according to the present embodiment. FIG. 1 is a perspective view showing a basic configuration of a printer system according to this embodiment. A printer system 100 according to this embodiment is a multifunction printer including a printer 110, which serves as a printing apparatus, and a scanner 120.

FIG. 1 shows a Y axis, an X axis that is orthogonal to the Y axis, and a Z axis that is orthogonal to the X axis and the Y axis. The arrow directions of the X, Y, and Z axes indicate + directions (positive directions), and the direction opposite to the arrow directions indicate − directions (negative directions). The printer system 100, when in use, is disposed on a horizontal plane defined by the X axis and the Y axis, and the +Y direction indicates the front of the printer system 100. The Z axis is an axis orthogonal to the horizontal plane, and the −Z direction is a vertically downward direction.

As shown in FIG. 1, the printer system 100 includes the printer 110, the scanner 120, and an ink supply portion 10. The printer system 100 has an operation panel 111, which serves as a user interface unit, on the front side.

In the operation panel 111, for example, buttons and the like for performing operations such as turning on and off of the power of the printer system 100, printing using the printer 110, and reading of a document using the scanner 120, and a display unit 47 for displaying operation status of the printer system 100, a message, and the like are disposed. In the operation panel 111, a reset button for a user to supply ink to ink tanks 11 and execute reset processing and the like are also disposed. The reset processing will be described later.

The printer 110 can eject ink, which serves as liquid, and perform printing on a print medium P such as printing paper. The printer 110 has a case portion 112. The case portion 112 constitutes the outer shell of the printer 110. An opening portion 113 is provided on the front side of the case portion 112. In the opening portion 113, a paper cassette 114 is detachably attached to the case portion 112. A paper discharge tray 115 is provided above (i.e., in the +Z direction relative to) the paper cassette 114 so as to be able to extend and retract in the frontward and rearward directions (+Y direction and −Y direction).

Although the details will be described later, the X-axis direction (+X direction and −X direction) is a main scanning direction HD of a print head of the printer 110, and the Y-axis direction (+Y direction and −Y direction) is a sub-scanning direction VD of the printer 110. A plurality of print mediums P are placed in a stacked manner in the paper cassette 114. The print mediums P placed in the paper cassette 114 are supplied one-by-one into the case portion 112 in the sub-scanning direction VD, printed by the printer 110, thereafter discharged from a paper discharge port 116 in the sub-scanning direction VD, and are placed on the paper discharge tray 115.

The scanner 120 is placed on the printer 110. The scanner 120 has a case portion 121. The case portion 121 constitutes the outer shell of the scanner 120. The scanner 120 is of a flatbed type, and has a document table (not shown) formed by a transparent plate-shaped member such as glass, and an imaging element (not shown) such as an image sensor. The scanner 120 can read out, as image data, an image or the like recorded on a medium such as paper via the imaging element.

The scanner 120 includes an automatic document feeder 122 at an upper end portion thereof. With the automatic document feeder 122, it is possible to sequentially feed and read the plurality of stacked documents (which are paper on which images or the like are recorded) while inverting them one-by-one. The scanner 120 is configured to be able to pivot with respect to the printer 110, and also has a function of a lid of the printer 110. The user can pivot the scanner 120 with respect to the printer 110 by inserting the fingers into a handle portion 123 and lifting up the scanner 120. The scanner 120 can thereby be opened with respect to the printer 110.

The ink supply portion 10 is disposed on the side of the printer 110 in the +X-axis direction. The ink supply portion 10 has a function of supplying ink IK (see FIG. 4B), which serves as liquid, to the printer 110. The ink supply portion 10 has a case portion 101. The ink tanks 11, which serve as a plurality of liquid vessels, are disposed in the case portion 101, and a plurality of different types of ink IK are separately contained in the plurality of ink tanks 11. That is to say, different types of ink IK are contained in the respective ink tanks 11.

In this embodiment, four ink tanks 11*a*, 11*b*, 11*c*, and 11*d* are provided. Also, in this embodiment, four types of ink, namely black ink and color inks that are yellow, magenta, and cyan inks are employed as the types of ink. Ink IKa, which is black ink, is contained in the ink tank 11*a*, and inks IKb, IKc, and IKd, which are color inks (yellow, magenta, and cyan) are contained respectively in the ink tanks 11*b*, 11*c*, and 11*d* (see FIG. 4B).

The ink tanks 11*a*, 11*b*, 11*c*, and 11*d* are arranged in a line in the Y-axis direction from the front side of the printer 110 and fixed within the case portion 101. Note that, in the following description, the four ink tanks 11*a*, 11*b*, 11*c*, and 11*d* and the four types of ink IKa, IKb, IKc, and IKd will be referred respectively to simply as ink tanks 11 and ink IK when not distinguished.

In this embodiment, the four ink tanks 11 are configured such that the ink IK can be injected into the ink tanks 11 from the outside of the printer system 100. Accordingly, the user of the printer system 100 can inject and supply the ink IK contained in other vessels into the ink tanks 11. Note that the detailed configuration of the ink tanks 11 will be described later.

The case portion 101 is provided with window portions 102 so as to correspond to the four ink tanks 11. The window portions 102 have optical transparency. For this reason, the user can visually recognize the four ink tanks 11 via the window portions 102. The window portions 102 may be provided as opening portions formed in the case portion 101, or may be constituted by a member having optical transparency.

At least a part of portions of the ink tanks 11 facing the window portions 102 also has optical transparency. Accordingly, the user can visually recognize the amount of the ink IK in the four ink tanks 11 via the window portions 102. An upper limit mark 17 is provided at a portion of each ink tank 11 that faces the corresponding window portion 102. The upper limit mark 17 indicates, as a guide, the upper limit for the supply of the ink IK such that the ink IK does not overflow from the ink tank 11 when the user injects the ink IK. In addition, the user can recognize the amount of the ink IK in each ink tank 11, using the upper limit mark 17 as a guide.

In this embodiment, the capacity of the ink tank 11*a* is larger than the capacities of the ink tanks 11*b*, 11*c*, and 11*d*. The capacities of the ink tanks 11*b*, 11*c*, and 11*d* are the same as one another. In the printer 110, it is assumed that a larger amount of the black ink IKa is consumed than the color inks IKb, IKc, and IKd. For this reason, of the four ink tanks 11, the ink tank 11*a* in which the black ink IKa is contained has a larger capacity than the capacities of the ink tanks 11*b*, 11*c*, and 11*d* in which the color inks IKb, IKc, and IKd are respectively contained. The ink tank 11*a* in which the black ink IKa is contained is disposed on the front side of the printer 110 such that the user can easily recognize the amount of the remaining ink.

Note that the order of arrangement of the ink tanks 11*b*, 11*c*, and 11*d* in which the color inks IKb, IKc, and IKd are contained from the front side is not particularly limited. In the case where any of the inks IKb, IKc, and IKd other than the black ink IKa is consumed more, this ink IK may be contained in the ink tank 11*a* having a large capacity.

A lid portion 103 is provided in an upper part of the case portion 101. The lid portion 103 engages with the case portion 101 so as to be able to pivot with respect thereto via a hinge portion 104. When the lid portion 103 is opened, the four ink tanks 11 are exposed. For example, when the user injects the ink IK into the ink tanks 11, the user can access the ink tanks 11 by pivoting the lid portion 103 to open it upward.

Configuration of Printer

Figure 2:
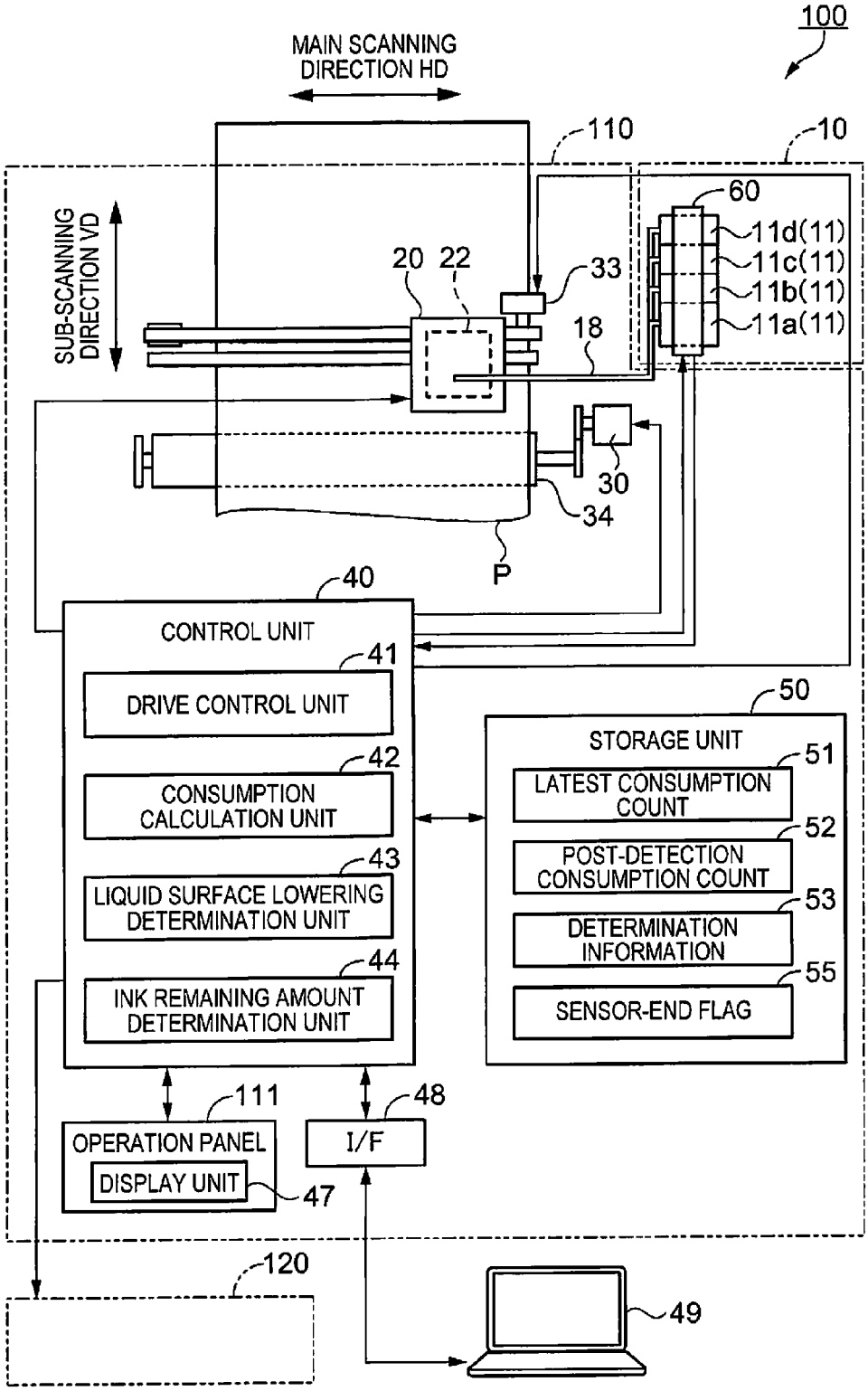
FIG. 2 is a schematic configuration diagram of a printer according to this embodiment.

Next, a configuration of the printer according to this embodiment will be described with reference to FIG. 2. FIG. 2 is a schematic configuration diagram of a printer according to the embodiment. As shown in FIG. 2, the printer 110 according to this embodiment includes a carriage 20, a paper feed motor 30, a carriage motor 33, a paper feed roller 34, a control unit 40, a storage unit 50, and a sensor 60. Note that FIG. 2 omits the scanner 120.

A print head 22 is installed in the carriage 20. The print head 22 has a plurality of nozzles that eject the ink IK toward the lower face side (the side in the −Z-axis direction) of the carriage 20. A tube 18 is provided between the print head 22 and each ink tank 11. The ink IK in each ink tank 11 is sent to the print head 22 via the tube 18. The print head 22 ejects, as ink droplets, the ink IK sent from each ink tank 11 toward the print medium P from the plurality of nozzles.

The carriage 20 is connected to the control unit 40 by a cable (not shown). The carriage 20 moves back and forth above the print medium P in the main scanning direction HD, as a result of being driven by the carriage motor 33. The paper feed motor 30 drives the paper feed roller 34 to rotate, and conveys the print medium P in the sub-scanning direction VD. Control of ejection of the print head 22 is performed by the control unit 40 via a cable.

That is to say, in the printer 110, the control unit 40 controls the paper feed motor 30, the carriage motor 33, and the print head 22, and the ink IK is thereby ejected from the plurality of nozzles of the print head 22 toward the print medium P conveyed in the sub-scanning direction VD, while the carriage 20 moves in the main scanning direction HD. As a result, printing is performed on the print medium P.

An end portion of a moving area of the carriage 20 in the main scanning direction HD is a home position area where the carriage 20 stands by. A cap (not shown) for performing maintenance, such as cleaning of the nozzles of the print head 22, or the like is disposed in the home position area, for example. FIG. 2 shows a state where the carriage 20 is located at the home position.

At the other end portion of the moving area of the carriage 20 in the main scanning direction HD (i.e., an end portion on the side opposite to the home position), a waste ink box (not shown) for receiving waste ink when performing flushing or cleaning of the print head, or the like is disposed. Note that "flushing" refers to ejection of the ink IK from the nozzles of the print head 22 during printing on the print medium P, the ejection being not related to the printing. "Cleaning" refers to cleaning of the inside of the print head by suctioning the print head using a pump or the like provided in the waste ink box without driving the print head.

The operation panel 111 that serves as a user interface unit and includes the display unit 47 is connected to the control unit 40. By the user operating the operation panel 111, the printer 110 and the scanner 120 can be operated by the control unit 40.

For example, in FIG. 1, a document is set in the automatic document feeder 122 in the scanner 120, and thereafter the user operates the operation panel 111 to start operations of the printer system 100. Then, the document is read out by the scanner 120. Subsequently, the print medium P is fed into the printer 110 (case portion 112) from the paper cassette 114 and this print medium P is printed by the printer 110 based on image data of the read document.

As shown in FIG. 2, a computer 49 can be connected to the control unit 40 via an interface (I/F) 48. The control unit 40 receives the image data from the computer 49 via the interface 48, and performs control for printing the image on the print medium P using the printer 110 (print head 22). The control unit 40 also reads out a document using the scanner 120, transmits the image data thereof to the computer 49 via the interface 48, or performs control for printing the read image.

The control unit 40 has a drive control unit 41, a consumption calculation unit 42, a liquid surface lowering determination unit 43, and an remaining ink amount determination unit 44. The control unit 40 is disposed in a main board (not shown). The control unit 40 includes a CPU, a ROM, a RAM, and the like (not shown). For example, the control unit 40 deploys, in the RAM, a control program stored in the ROM, and functions as each part of the control unit 40 as a result of the CPU executing the control program deployed in the RAM. Alternatively, instead of including the CPU, the control unit 40 may be constituted by hardware such as an ASIC (Application Specific IC) that achieves the same function as a function executed by the CPU and the control program, or may be constituted by both the CPU and the ASIC.

The drive control unit 41 controls the carriage motor 33 and performs control for moving the carriage 20. Thereby, the carriage motor 33 performs driving for moving the print head 22 provided in the carriage 20.

The consumption calculation unit 42 calculates the consumption of the ink that is consumed by ejecting the ink IK from the nozzles of the print head 22. The consumption calculation unit 42 starts calculation of the ink consumption with a state where each ink tank 11 is filled with the ink IK as a reference (initial value). More specifically, upon the user supplying the ink IK to the ink tank 11 and pressing the reset button, the consumption calculation unit 42 initializes the count value of the ink consumption (i.e., restores the count value to an initial value, e.g., a count value indicating an ink consumption of 0 g) and starts to integrate the ink consumption for this ink tank 11. Then, the integration of the ink consumption is continuously performed until the user again presses the reset button, or later-described automatic reset processing is executed for this ink tank 11.

The ink consumption calculated by the consumption calculation unit 42 includes not only the ink consumption due to printing on the print medium P but also the consumption of the ink used in maintenance of the print head with the cleaning or the flushing of the nozzles of the print head 22. The ink consumption is indicated by a count value obtained by a so-called dot-counting method. That is to say, at the time of printing, the consumption of ink consumed in printing per dot in design is multiplied by the number of dots required by image data to be printed based on the image data to be printed, by the consumption calculation unit 42. Thereby, the integrated consumption of the ink consumed in printing for a single path is calculated.

Furthermore, the consumption calculation unit 42 integrates the calculated ink consumption for a single path with a state where each ink tank 11 is filled with the ink IK as a reference (initial value), and thereby calculates the ink consumption in each ink tank 11. In this embodiment, the ink consumption is calculated as the amount of each ink IK ejected from the nozzles of the print head 22 (i.e., the amount of the ink IK per dot×the number of ejected dots) for every single path through which the carriage 20 scans once, and the ink consumption integrated since the initial value is updated.

The ink consumption at the time of performing the cleaning or the flushing is calculated as the amount of the ink IK used during single time of the cleaning or the flushing. The count value of the ink consumption is stored during printing as a latest consumption count 51 in the storage unit 50 every time a unit amount of the ink IK is consumed, or every time the paper is discharged, for example. Also, at every time of the cleaning or the flushing, the ink consumption is stored as the latest consumption count 51 in the storage unit 50.

Although not shown in the diagrams, in the printer 110, when the user performs an operation of executing printing, for example, the estimated amount of the remaining ink IK in each ink tank 11 can be displayed on a monitor (screen) of the computer 49 based on the count value of the ink consumption. Accordingly, the user can visually recognize the amount of the remaining ink IK in each ink tank 11 via the window portion 102 of the ink tank 11, and also check the estimated amount of the remaining ink IK through the monitor of the computer 49.

In addition, it is also possible to allow a remote user to recognize the amount of the remaining ink by outputting, through wired or wireless communication, the estimated amount of the remaining ink in each ink tank 11 that is based on the count value to the computer 49 or an external terminal outside the printer system 100 and displaying the estimated amount of the remaining ink on the monitor of the computer 49 or the external terminal. Note that, in addition to the above configuration, a configuration may be employed in which the estimated amount of the remaining ink in each ink tank 11 that is based on the count value is displayed on the display unit 47 of the operation panel 111 in the printer 110.

The liquid surface lowering determination unit 43 executes, for each ink tank 11, remaining ink detection using the sensor 60. A pair of electrodes 15 and 16, which serve as a pair of conductive members that are a part of the later-described sensor 60, are separately disposed in each ink tank 11 (see FIG. 4B).

Upon applying a voltage to the pair of electrodes 15 and 16, a resistance value between the pair of electrodes 15 and 16 when both the electrodes 15 and 16 are soaked in the ink IK is different from that when not being soaked. The liquid surface lowering determination unit 43 determines whether or not the ink IK is present at a predetermined position in each ink tank 11, i.e., at a predetermined height from a bottom portion thereof, based on the resistance value between the pair of electrodes 15 and 16 when the remaining ink detection is executed.

When a print job is being executed, the liquid surface lowering determination unit 43 executes the remaining ink detection using the sensor 60 every time a first predetermined amount of the ink IK is consumed. A state where it is determined as a result of the liquid surface lowering determination unit 43 executing the remaining ink detection that the ink IK is not present at the predetermined height in the ink tank 11 based on the resistance value between the pair of electrodes 15 and 16 will be referred to as "sensor-end". The control unit 40 sets a sensor-end flag 55 for the ink tank 11 for which sensor-end determination has been made, and stores the set sensor-end flag 55 in the storage unit 50.

Once the sensor-end flag 55 is set, the consumption calculation unit 42 starts to calculate the ink consumption after the sensor-end for the ink tank 11 for which the sensor-end determination has been made. The count value of the ink consumption after the sensor-end is updated every time a unit amount of the ink IK is consumed, and is stored as a post-detection consumption count 52 in the storage unit 50.

The count value of the ink consumption after the sensor-end is calculated starting from a latest consumption count value at the time of last determination that the ink IK is present at the predetermined height before the liquid surface lowering determination unit 43 makes the sensor-end determination. For this reason, it is possible to reduce the risk that the actual consumption of the ink IK consumed after the sensor-end becomes larger than the count value stored as the post-detection consumption count 52. It is thereby possible to suppress the risk of occurrence of idle ejection before the later-described remaining ink amount determination unit 44 makes ink-end determination based on the count value of the ink consumption after the sensor-end.

Note that, instead of calculating the ink consumption after the sensor-end, a configuration may be employed in which the count value at the time of last determination that the ink IK is present at the predetermined height before the sensor-end determination is made is stored as a consumption count at the time of detection, and a differential value between this consumption count at the time of detection and the latest consumption count 51 is used as the ink consumption after the sensor-end.

The remaining ink detection by the liquid surface lowering determination unit 43 is repeatedly executed at a detection timing, such as when the power of the printer 110 (printer system 100) is turned on, when a print job is being executed, or when a print job is not being executed. The detection timing of executing the remaining ink detection will be described later.

However, the liquid surface lowering determination unit 43 does not execute the remaining ink detection for the ink tank 11 for which the sensor-end determination has been once made and the sensor-end flag 55 has been set, until the ink consumption after the sensor-end becomes larger than or equal to a later-described second predetermined amount (i.e., the count value of the ink consumption becomes larger than or equal to a predetermined value A). This is for the following reason.

For example, there are cases where it is erroneously determined that the ink IK is present at the predetermined height as a result of the next remaining ink detection after it is once determined that the ink IK is not present at the predetermined height, due to movement of the liquid surface caused by a tilt of the printer 110 (printer system 100), or generation of air bubbles in the ink IK, for example. Then, there is concern that the result of the remaining ink detection changes and confuses the user, or it is erroneously detected that the ink IK is present at the predetermined position although the ink IK is actually not at the predetermined position, resulting in occurrence of idle ejection.

For this reason, execution of the remaining ink detection is stopped for the ink tank 11 for which the sensor-end determination has been once made and the sensor-end flag 55 has been set, until the second predetermined amount of the ink IK or more is consumed after it is detected that the liquid is not present at the predetermined height. It is thereby possible to avoided erroneous detection that may possibly cause idle ejection or a change of the detection result which confuses the user. Note that the second predetermined amount (predetermined value A) is set to a value larger than the first predetermined amount.

The liquid surface lowering determination unit 43 resumes execution of the remaining ink detection if, after making the sensor-end determination on any of the ink tanks 11, the count value of the ink consumption of this ink tank 11 after the sensor-end becomes larger than or equal to the predetermined value A corresponding to the second predetermined amount.

The remaining ink amount determination unit 44 determines the state of the remaining ink IK in each ink tank 11 based on the count value of the ink consumption after the sensor-end stored as the post-detection consumption count 52 and determination information that is set for each ink tank 11.

The state of the remaining ink IK is determined to be "ink-low", which indicates that the amount of the remaining ink IK in the ink tank 11 is small, or "ink-end", which indicates that no consumable amount of the ink IK remains in the ink tank 11. The state of the remaining ink IK is determined based on determination information 53 that is stored in the storage unit 50.

The determination information 53 includes, as predetermined amounts set for each ink tank 11, the aforementioned first predetermined amount, the second predetermined amount (predetermined value A), and a third predetermined amount (predetermined value B). Note that the predetermined value A is a count value corresponding to the second predetermined amount of ink consumption, and the predetermined value B is a count value corresponding to the third predetermined amount of ink consumption.

The remaining ink amount determination unit 44 resumes the remaining ink detection when the count value of the ink consumption after the sensor-end of the ink tank 11 for which the sensor-end determination has been made becomes larger than or equal to the predetermined value A corresponding to the second predetermined amount, and if it is determined that the ink IK is not present at the predetermined height, the remaining ink amount determination unit 44 makes ink-low determination for this ink tank 11. With respect to the ink tank 11 for which the ink-low determination has been made, the control unit 40 displays, on the display unit 47, an "ink-low notification" that notifies the user of a decrease in the amount of the remaining ink IK and prompts the user to supply the ink IK.

The remaining ink amount determination unit 44 makes ink-end determination when the count value of ink consumption after the sensor-end stored in the post-detection consumption count 52 becomes larger than or equal to the predetermined value B corresponding to the third predetermined value. Upon making the ink-end determination, the control unit 40 stops the printing operation of the printer 110 in order to avoid an idle-ejecting state resulting from the ink IK to be ejected running out. Then, with respect to the ink tank 11 for which the ink-end determination has been made, the control unit 40 displays, on the display unit 47, the "ink-end notification" that notifies the user that the ink IK has run out and prompts the user to supply the ink IK. Note that the third predetermined amount (predetermined value B) is set to a value larger than the second predetermined amount (predetermined value A).

If the ink-end determination has been once made and the printing operation is stopped, the reset processing is executed by the user pressing the reset button, and the printer 110 does not operate until it is determined that the ink IK remains by the liquid surface lowering determination unit 43. If the user supplies the ink IK to the ink tank 11 for which the ink-end determination has been made and presses the reset button, and the control unit 40 receives, via the operation panel 111, input indicating that the ink IK has been supplied, the remaining ink detection is executed by the liquid surface lowering determination unit 43. If it is determined that the ink IK is present at the predetermined height, the reset processing is executed, and the printer 110 enters a state of being able to perform the printing operation.

The storage unit 50 stores information in a nonvolatile and rewritable manner. The storage unit 50 is constituted by a nonvolatile memory such as an EEPROM, for example. A configuration may be employed in which the ROM included in the control unit 40 performs the function of the storage unit 50. The storage unit 50 has an area in which the latest consumption count 51, the post-detection consumption count 52, and the determination information 53 are stored. The storage unit 50 also has an area for storing the sensor-end flag 55.

As mentioned above, the count value of the latest consumption count 51 is updated as appropriate based on the ink consumption calculated for each ink tank 11 by the consumption calculation unit 42. Upon the reset processing being executed by the user supplying the ink IK in any of the ink tanks 11 and pressing the reset button, the latest consumption count 51 stored for this ink tank 11 is cleared and restored to the initial value thereof. The reset processing is processing for setting the count value of the latest consumption count 51 to the initial value.

The post-detection consumption count 52 is updated as appropriate for the ink tank 11 for which the sensor-end determination has been made, based on the ink consumption calculation performed by the consumption calculation unit 42. If the reset processing is executed by the user supplying the ink IK to the ink tank 11 and pressing the reset button, and it is determined that the ink IK remains by the liquid surface lowering determination unit 43, the post-detection consumption count 52 stored for this ink tank 11 is cleared and restored to the initial value thereof.

As mentioned above, the determination information 53 includes the first predetermined amount, the second predetermined amount (the predetermined value A), and the third predetermined amount (the predetermined value B). The first predetermined amount, the second predetermined amount (the predetermined value A), and the third predetermined amount (the predetermined value B) are the values that are set for each ink tank 11, i.e., each type of the ink IK. The control unit 40 uses the latest consumption count 51 for the comparison with the first predetermined amount, and uses the post-detection consumption count 52 for comparison with the second predetermined amount and the third predetermined amount.

The reset processing is processing for supplying the ink IK and initializing the count value of ink consumption (i.e., restoring the count value to the initial value) for the ink tank 11 for which the ink-low or ink-end determination has been made. The reset processing is executed by the user pressing the reset button in the operation panel 111. If the reset processing is executed by a manual operation of the user, the liquid surface lowering determination unit 43 executes the remaining ink detection, and if it is checked that the ink IK is present at the predetermined height, the sensor-end flag 55 is deleted if it has been set, the count values stored as the latest consumption count 51 and the post-detection consumption count 52 are restored to the initial values thereof, and calculation of the ink consumption is started.

Note that the reset processing performed by a manual operation of the user can be executed at any time by pressing the reset button regardless of the amount (consumption) of the remaining ink IK or whether or not the sensor-end flag 55 has been set.

In this embodiment, considering the case where, for example, the user forgets to press the reset button even though the user has supplied the ink IK to the ink tank 11, "automatic reset processing" is executed for restoring the count values stored as the latest consumption count 51 and the post-detection consumption count 52 to the initial values thereof under a specific condition even if the user does not press the reset button. The automatic reset processing will be described later.

Configuration of Ink Supply Portion and Sensor

Figure 3:
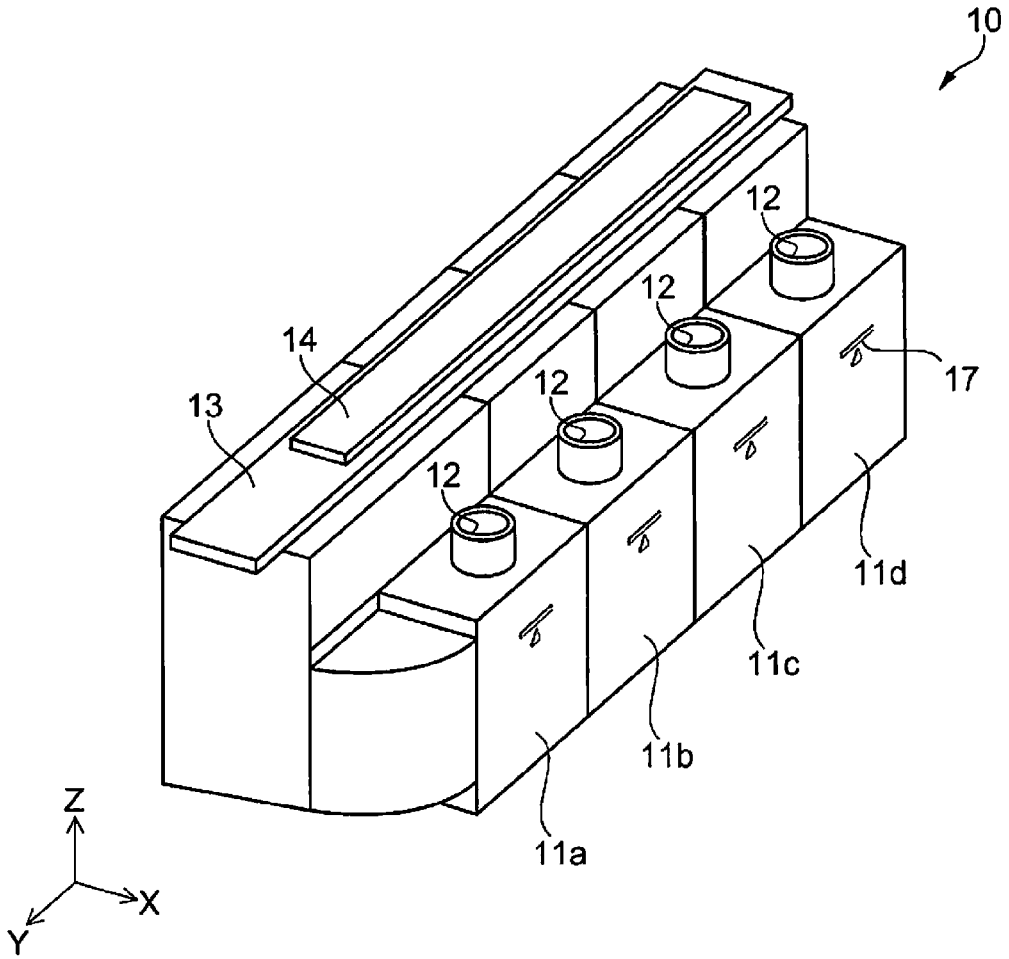
FIG. 3 is a schematic configuration diagram of an ink supply portion according to this embodiment.
Figure 4A:
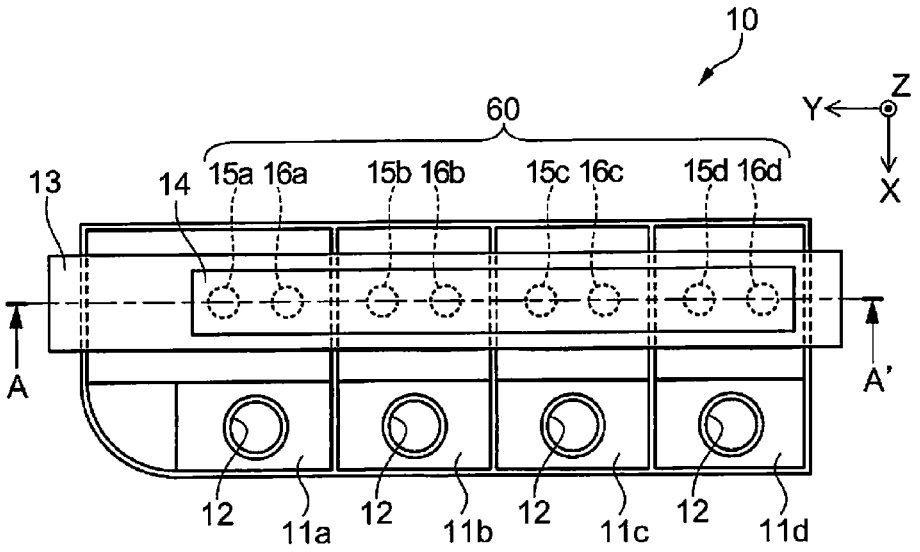
FIGS. 4A and 4B are schematic configuration diagrams of the ink supply portion according to this embodiment.
Figure 4B:
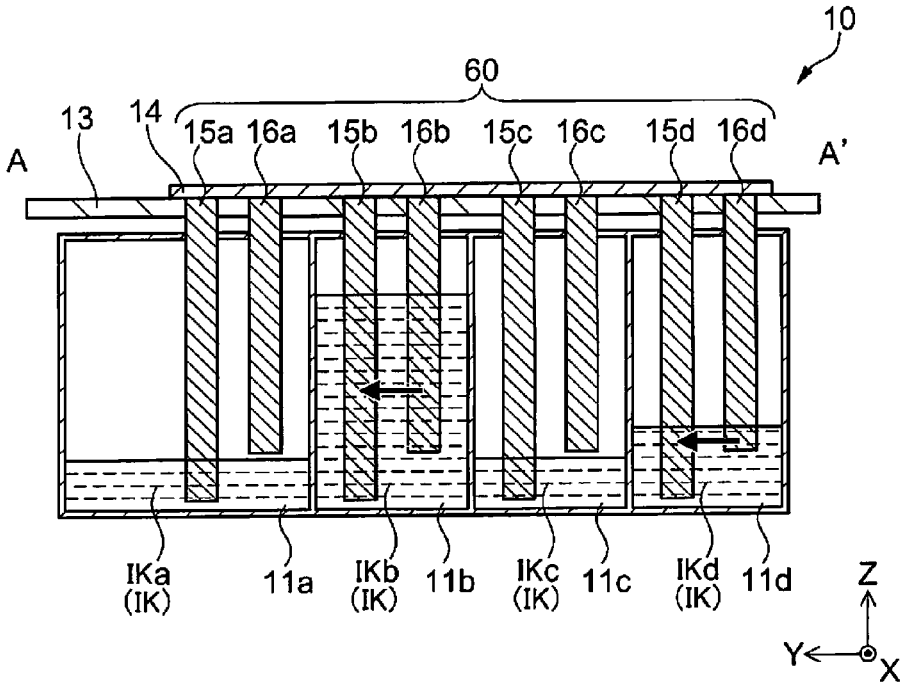
Figure 5:
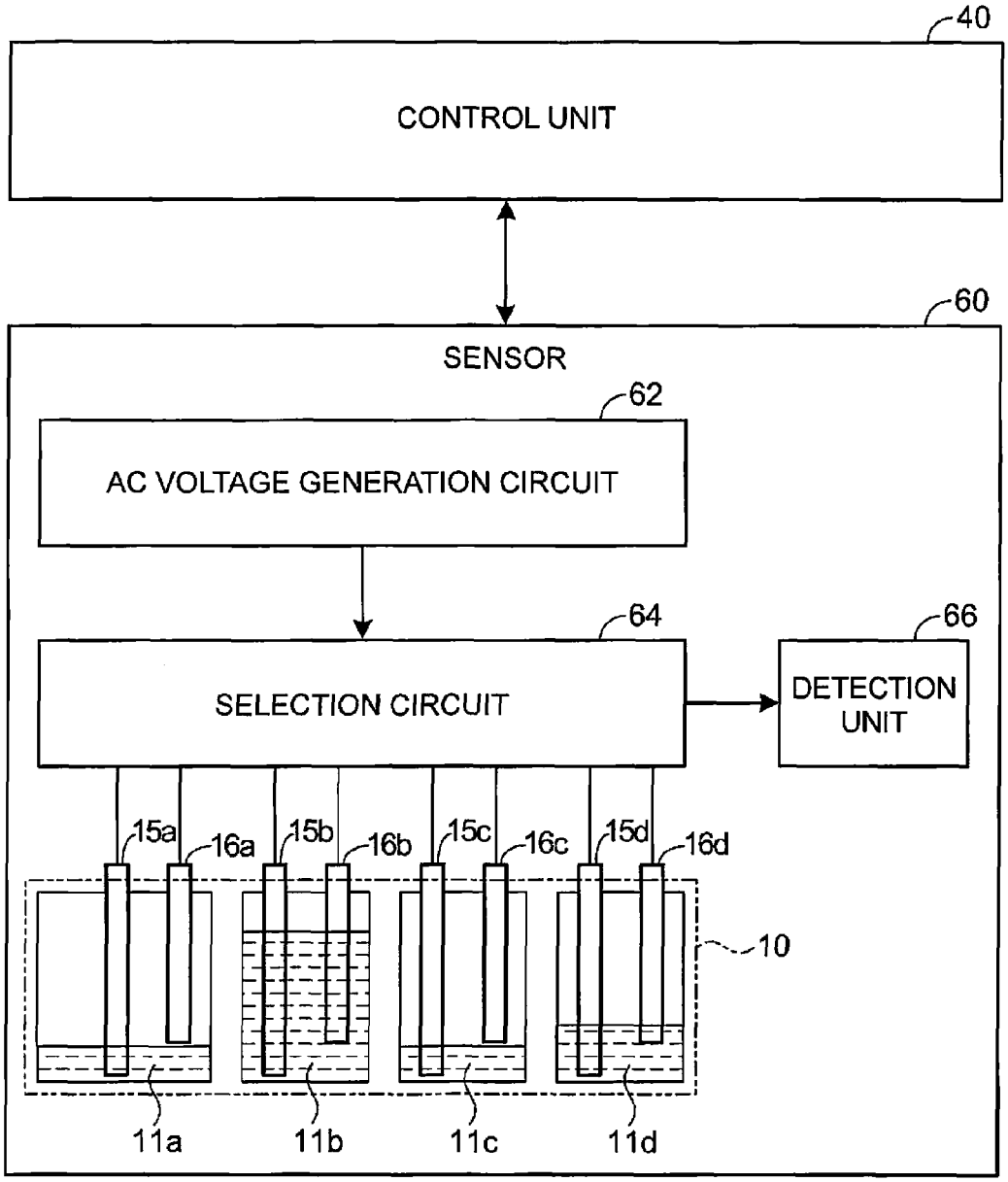
FIG. 5 is a block diagram showing a schematic configuration of a sensor according to this embodiment.

Next, a configuration of the ink supply portion and the sensor according to this embodiment will be described with reference to FIGS. 3, 4A, 4B, and 5. FIGS. 3, 4A, and 4B are schematic configuration diagrams of the ink supply portion according to this embodiment. Specifically, FIG. 3 is a perspective view of the ink supply portion, FIG. 4A is a plan view of the ink supply portion, and FIG. 4B is a cross-sectional view taken along line A-A' in FIG. 4A. Note that FIGS. 3, 4A, and 4B show a state where the case portion 101 has been removed from the ink supply portion 10 shown in FIG. 1. FIG. 5 is a block diagram showing a schematic configuration of the sensor according to this embodiment.

As shown in FIGS. 3, 4A, and 4B, the ink supply portion 10 includes the four ink tanks 11*a*, 11*b*, 11*c*, and 11*d*, a holding portion 13, a detection board 14, and four pairs of electrodes 15 and 16 (see FIGS. 4A and 4B) that are a part of the sensor 60 and disposed in the respective four ink tanks 11*a*, 11*b*, 11*c*, and 11*d* (i.e., a pair of electrodes 15 and 16 are disposed in each ink tank 11).

As shown in FIG. 3, the ink tanks 11*a*, 11*b*, 11*c*, and 11*d* are arranged in a line in the Y-axis direction. The ink tanks 11 are formed by synthetic resin such as nylon or polypropylene, for example. The four ink tanks 11 may be separately configured, or may be integrally configured. In the case of integrally configuring the ink tanks 11, the ink tanks 11 may be integrally molded, or four ink tank 11 that are separately molded may be integrally bundled or connected.

In this embodiment, an upper face of a part of the ink tanks 11 on the front side (i.e., the side in the +X direction) is lower than an upper face of a part of the ink tanks 11 on the rear side (i.e., the side in the −X direction). Injection ports 12 for injecting the ink IK from the outside are provided in the upper face of the part of the ink tanks 11 on the front side. The ink IK of the respective colors can be supplied to the ink tanks 11 by the user injecting the ink IK from these injection ports 12. Although not shown in the diagrams, the ink IK that is to be supplied to the ink tanks 11 by the user is provided in a state of being contained in separate supply containers (refill bottles).

Regarding the ink tanks 11, the Z-axis direction, the Y-axis direction, and the X-axis direction are also referred to respectively as a height direction, a width direction, and a depth direction. As mentioned above, the capacity of the ink tank 11*a* in which the black ink IKa is contained is larger than the capacities of the ink tanks 11*b*, 11*c*, and 11*d* in which the color inks IKb, IKc, and IKd are contained. Comparing the ink tank 11*a* with the ink tanks 11*b*, 11*c*, and 11*d*, the height and the depth are the same, but the width is different. That is to say, the width (i.e., the length in the Y-axis direction) of the ink tank 11*a* is larger than the widths of the ink tanks 11*b*, 11*c*, and 11*d*.

The holding portion 13, which extends in the Y-axis direction in which the ink tanks 11*a*, 11*b*, 11*c*, and 11*d* are arranged in a line, is disposed above a part of the ink tanks 11 on the rear side. The holding portion 13 is fixed to the four ink tanks 11 by screws or the like, for example. The holding portion 13 has a function of holding the detection board 14 disposed thereabove. The holding portion 13 is formed by insulating synthetic resin or the like, for example. The detection board 14, which extends in the Y-axis direction in which the ink tanks 11*a*, 11*b*, 11*c*, and 11*d* are arranged in a line, is disposed on the holding portion 13. The detection board 14 is held by the holding portion 13.

As shown in FIG. 5, the sensor 60 has an AC voltage generation circuit 62, a selection circuit 64, a detection unit 66, and the four pairs of electrodes 15 and 16 (i.e., a pair in each ink tank 11). The AC voltage generation circuit 62 generates an AC voltage to be applied to each pair of electrodes 15 and 16. The detection unit 66 detects a signal that is based on a resistance value between each pair of electrodes 15 and 16.

The selection circuit 64 is constituted by an analog switch, for example, and selectively connects the pair of electrodes 15 and 16 disposed in any one of the four ink tanks 11 to the AC voltage generation circuit 62 and the detection unit 66. The selection circuit 64 is provided in the detection board 14 shown in FIGS. 4A and 4B. The AC voltage generation circuit 62 and the detection unit 66 may be provided in the detection board 14, or a part of or the entire AC voltage generation circuit 62 and detection unit 66 may be provided in the main board.

As shown in FIGS. 4A and 4B, a total of four pairs of electrodes 15 and 16 corresponding to the four ink tanks 11 are arranged in a line in the extending direction of the detection board 14. The pairs of electrodes 15 and 16 are electrically connected to the detection board 14 via a spring-like connector or the like, for example. The detection board 14 is connected to the control unit 40 by an FFC (Flexible Flat Cable) (not shown) or the like. The output of the sensor 60 is thereby input to the liquid surface lowering determination unit 43 in the control unit 40.

As shown in FIG. 4B, the pairs of electrodes 15 and 16 are disposed within the respective ink tanks 11. The pairs of electrodes 15 and 16 each have a long direction, and are disposed such that the long direction extends downward (i.e., in the −Z direction) from the detection board 14 along the height direction of the ink tanks 11 (i.e., Z-axis direction). The pairs of electrodes 15 and 16 are constituted by metallic material such as stainless steel, for example.

One electrode in each pair of electrodes, i.e., the electrode 15 has a length with which a leading end portion on the lower side thereof reaches a position close to a bottom portion of the corresponding ink tank 11. The other one electrode in each pair of electrodes, i.e., the electrode 16 is shorter than the electrode 15, and has a length with which a leading end portion on the lower side thereof reaches a position at a predetermined height from the bottom portion of the corresponding ink tank 11. The predetermined height from the bottom portion at which the leading end portion of the electrode 16 is located is set to the same height for the four ink tanks 11. This predetermined height is set as appropriate based on the capacities of the ink tanks 11*a*, 11*b*, 11*c*, and 11*d*, the consumption of the respective inks IK during a predetermined period, or the like, for example.

When executing the remaining ink detection, the control unit 40 transmits, to the selection circuit 64, a selection signal for selecting an ink tank 11 for which the remaining ink detection is to be executed from among the four ink tanks 11. The control unit 40 also transmits an instruction signal for giving an instruction to generate an AC voltage, to the AC voltage generation circuit 62.

The selection circuit 64 connects the pair of electrodes 15 and 16 disposed in the selected one of the ink tanks 11 to the AC voltage generation circuit 62 and the detection unit 66 based on the selection signal from the control unit 40. Then, the AC voltage generation circuit 62 applies the AC voltage to the selected pair of electrodes 15 and 16 based on the instruction signal from the control unit 40. It is favorable that the voltage applied to the pair of electrodes 15 and 16 is an AC voltage, from a viewpoint of suppressing deposition of the ink IK.

Upon the AC voltage being applied to the pair of electrodes 15 and 16, the resistance value between the pair of electrodes 15 and 16 is infinite when the ink IK has run out, and is a resistance value corresponding to the ink IK when the ink IK remains. In FIG. 4B, when attention is paid to the ink tank 11*b*, for example, the height of the liquid surface of the ink IKb contained in the ink tank 11*b* is higher than or equal to the predetermined height. That is to say, in the ink tank 11*b*, both electrodes in the pair of electrodes 15 and 16 are in a state of being soaked in the ink IKb. For this reason, when executing the remaining ink detection for the ink tank 11*b*, a current corresponding to the resistance between the pair of electrodes 15 and 16 flows due to the applied AC voltage.

The signal that is based on the resistance value between the pair of electrodes 15 and 16 disposed in the ink tank 11*b* is output to the detection unit 66, and a result of the detection performed by the detection unit 66 is output to the liquid surface lowering determination unit 43 (control unit 40). As a result, the liquid surface lowering determination unit 43 determines for the ink tank 11*b* that the ink IKb is present at the predetermined height. Similarly, in the ink tank 11*d* in which the height of the liquid surface of the contained ink IKd is higher than or equal to the predetermined height as well, a current flows between the pair of electrodes 15 and 16 through the ink IKd due to the AC voltage applied as a result of executing the remaining ink detection, and accordingly, the liquid surface lowering determination unit 43 determines that the ink IKd is present at the predetermined height.

On the other hand, when attention is paid to the ink tank 11*a*, the height of the liquid surface of the ink IKa contained in the ink tank 11*a* is lower than the predetermined height. That is to say, in the ink tank 11*a*, the electrode 16 is in a state of not being soaked in the ink IKa. For this reason, when the remaining ink detection is executed for the ink tank 11*a*, a current does not flow between the pair of electrodes 15 and 16 even if an AC voltage is applied.

As a result, the liquid surface lowering determination unit 43 makes "sensor-end" determination, which indicates that the ink IKa is not present at the predetermined height, for the ink tank 11*a*. Similarly, in the ink tank 11*c* in which the height of the liquid surface of the contained ink IKc is lower than the predetermined height as well, a current does not flow between the pair of electrodes 15 and 16 when the remaining ink detection is executed even if an AC voltage is applied, and accordingly, the liquid surface lowering determination unit 43 makes the "sensor-end" determination indicating that the ink IKc is not present at the predetermined height.

Thus, in this embodiment, it is possible to detect whether or not the ink IK is present at the predetermined height from the bottom portion in each ink tank 11 based on whether a current flows between the corresponding pair of electrodes 15 and 16 in the sensor 60 (i.e., based on a difference in the resistance value). The liquid surface lowering determination unit 43 repeatedly executes, for each ink tank 11, the detection of whether or not the ink IK is present at the predetermined height from the bottom portion at a later-described detection timing.

With the configuration of the sensor 60 according to this embodiment, the selection circuit 64 selects the pair of electrodes 15 and 16 disposed in any one of the ink tanks 11 and connects the electrodes 15 and 16 to the AC voltage generation circuit 62 and the detection unit 66. Accordingly, the configuration of the sensor 60 can be simplified since the remaining ink detection for the plurality of ink tanks 11 can be performed by a single AC voltage generation circuit 62 and a single detection unit 66. As a result, the size and the manufacturing costs of the printer 110 can be suppressed.

When the ink IK is consumed as a result of the printer 110 repeating printing and the liquid surface lowering determination unit 43 performs the determination, if the liquid surface of the ink IK in any of the ink tanks 11 is lower than the predetermined height, the "sensor-end" determination indicating that the ink IK is not present at the predetermined height is made for this ink tank 11.

After the liquid surface lowering determination unit 43 detects that the ink IK is not present at the predetermined height and the remaining ink amount determination unit 44 makes the sensor-end determination, if the ink IK is consumed, the liquid surface thereof further lowers, and the ink IK to be sent from the ink tank 11 to the print head 22 (see FIG. 2) runs out, an idle-ejecting state occurs. In this embodiment, in order to avoid an idle-ejecting state, the remaining ink amount determination unit 44 performs determination of a decrease in the amount of the remaining ink in two steps, namely ink-low and ink-end.

The control unit 40 notifies the user of a decrease in the amount of the remaining ink and provides a warning for prompting the user to supply the ink IK before the ink IK in the ink tank 11 runs out, by means of lighting of a lamp on the operation panel 111 or display on the display unit 47, based on a result of the determination performed by the remaining ink amount determination unit 44.

The amount of the remaining ink IK for performing the determination in two steps that are ink-low and ink-end is set as follows, for example. Initially, in order to reliably avoid occurrence of an idle-ejecting state resulting from the ink IK in each ink tank 11 running out, the minimum amount of the remaining ink IK with which an idle-ejecting state will not occur is set for each ink tank 11. It is favorable that this minimum amount of the ink IK remains in each ink tank 11 at the time point when the remaining ink amount determination unit 44 makes the ink-end determination.

Next, prior to this determination, it is necessary, in order to avoid occurrence of an idle-ejecting state, to have the user supply the ink IK to the ink tank 11 before the ink-end determination is made after the ink-low determination is made. It is desirable that the user has refill ink IK on hand, but there can be the case where the ink IK is out of stock.

For this reason, a printer vendor estimates a predetermined lead time (e.g., a week) for the user to prepare the refill ink IK, estimates the consumption of each ink IK that will be consumed during a period until the ink-end determination is made after the ink-low determination is made, and sets the amount of remaining ink that is necessary at the time point when the ink-low determination is made (the amount of remaining ink at the time of making ink-low determination). In design, at the time point when the remaining ink amount determination unit 44 makes the ink-low determination, the ink IK whose amount is larger than or equal to the aforementioned amount of remaining ink at the time of making ink-low determination remains in addition to the aforementioned minimum amount of remaining ink in each ink tank 11. Note that the lead time may be set by the printer vendor based on the total result of the status of use of the printer 110 by the printer user or the like.

In this embodiment, the remaining ink detection is resumed if the second predetermined amount (predetermined value A) of the ink IK or more is consumed after the sensor-end determination is once made, and if it is then detected that the ink IK does not remain, the remaining ink amount determination unit 44 makes the ink-low determination for this ink tank 11. After the sensor-end determination is once made, if the third predetermined amount (predetermined value B) of the ink IK or more is consumed, the remaining ink amount determination unit 44 makes the ink-end determination for this ink tank 11 and stops the printing operation. The third predetermined amount is set to an amount defined by adding the second predetermined amount to the amount of remaining ink at the time of making ink-low determination.

Note that, as mentioned above, the second predetermined amount (predetermined value A) and the third predetermined amount (predetermined value B) are compared with a count value that is calculated starting from the latest consumption count value at the time when the liquid surface lowering determination unit 43 determines for the last time that the ink IK is present at the predetermined height before making the sensor-end determination.

It is also desirable that, when the user supplies the ink IK to the ink tank 11 before the ink-end determination is made after the ink-low determination is made, the ink IK does not overflow from the ink tank 11 even if the user supplies the entire amount of the ink IK contained in the refill bottle to the ink tank 11. Accordingly, in this embodiment, the capacity of each ink tank 11 is set to an amount defined by further adding a margin to a total of the amount of remaining ink at the time of making ink-low determination and the entire amount of the refill bottle.

Note that the capacity of the refill bottle in which the ink IK to be supplied by the user is contained depends on the type of the ink 1K. In other words, the capacity of the refill bottle is different in accordance with the capacity of the ink tank 11 in which each ink IK is contained. In this embodiment, since the capacities of the ink tanks 11*b*, 11*c*, and 11*d* in which the color inks IKb, IKc, and IKd are contained are the same as one another, the capacities of refill bottles in which the refill color inks IKb, IKc, and IKd are contained are also the same. Meanwhile, since the capacity of the ink tank 11*a* in which the black ink IKa is contained is larger than the capacities of the ink tanks 11*b*, 11*c*, and 11*d*, the capacity of a refill bottle in which the refill black ink IKa is contained is larger than the capacities of the refill bottles in which the refill color inks IKb, IKc, and IKd are contained.

Here, as mentioned above, the predetermined height for detecting the lowering of the liquid surface of the ink IK is set to the same height for the ink tanks 11*a*, 11*b*, 11*c* and 11*d*. Meanwhile, the width of the ink tank 11*a* in which the black ink IKa is contained is larger than the widths of the ink tanks 11*b*, 11*c*, and 11*d*. That is to say, the cross-sectional area (bottom area) of the ink tank 11*a* in an X-Y plane is larger than the cross-sectional areas (bottom areas) of the ink tanks 11*b*, 11*c*, and 11*d*. Accordingly, the amount of remaining ink at the time of making ink-low determination for the black ink IKa in the ink tank 11*a* is larger than the amounts of remaining ink at the time of making ink-low determination for the color inks IKb, IKc, and IKd in the ink tanks 11*b*, 11*c*, and 11*d*.

This is because it is assumed that a larger amount of the black ink IKa is consumed compared with the color inks IKb, IKc, and IKd, and accordingly, the first predetermined amount, the second predetermined amount, and the third predetermined amount for the black ink IKa (ink tank 11*a*) are set to larger values than the first predetermined values, the second predetermined values, and the third predetermined values for the color inks IKb, IKc, and IKd (ink tanks 11*b*, 11*c*, and 11*d*).

Thus, by setting the first predetermined amount, the second predetermined amount, and the third predetermined amount as appropriate based on the amount of the respective inks 1K to be used, the amount of the remaining ink IK can be accurately detected using the pairs of electrodes 15 and 16 having the same configuration in common even if the capacities of the ink tanks 11 are different.

Method for Executing Remaining Ink Detection

Figure 6:
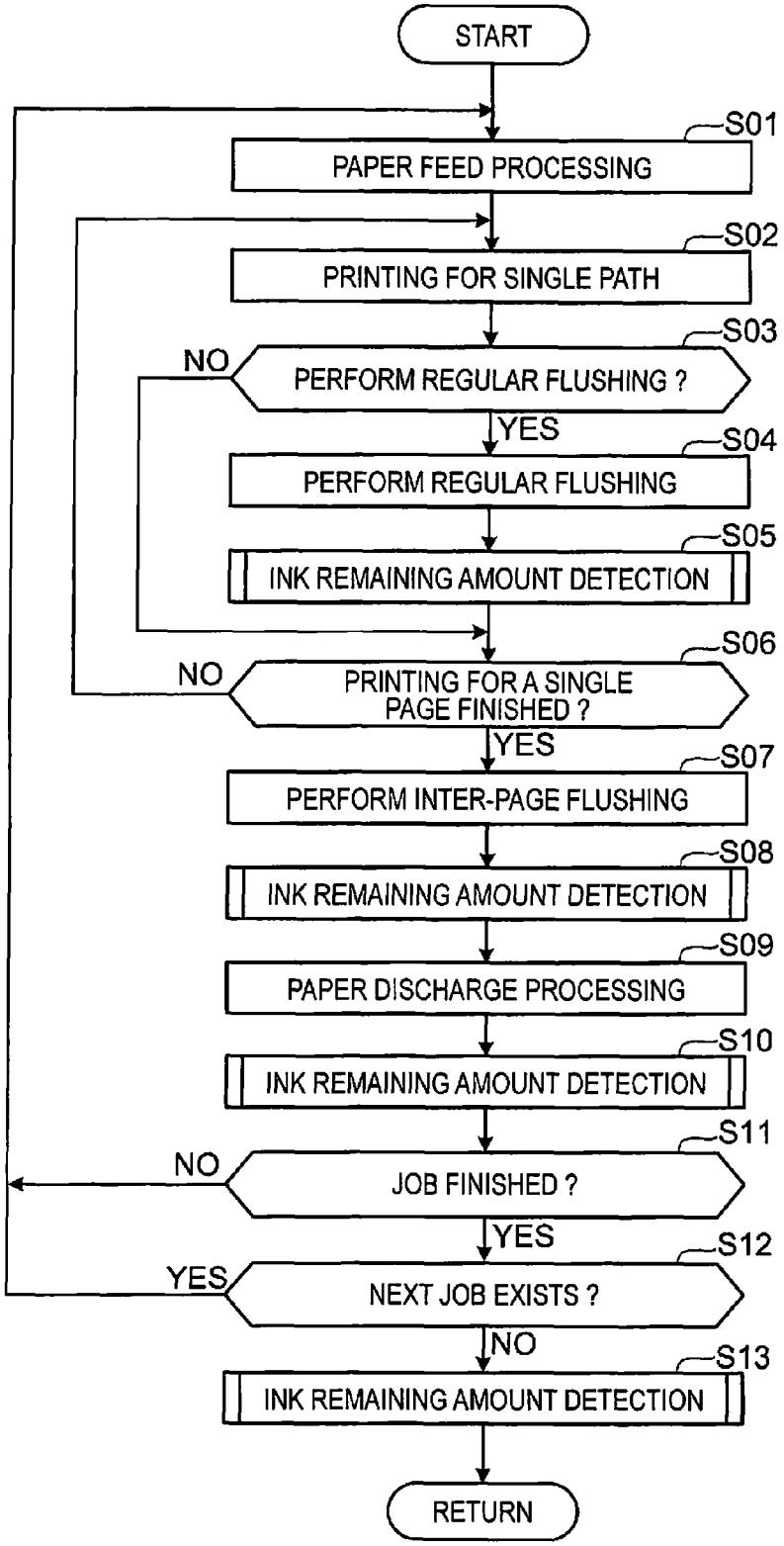
FIG. 6 is a flowchart showing a method for executing remaining ink detection when a print job is being executed.
Figure 7:
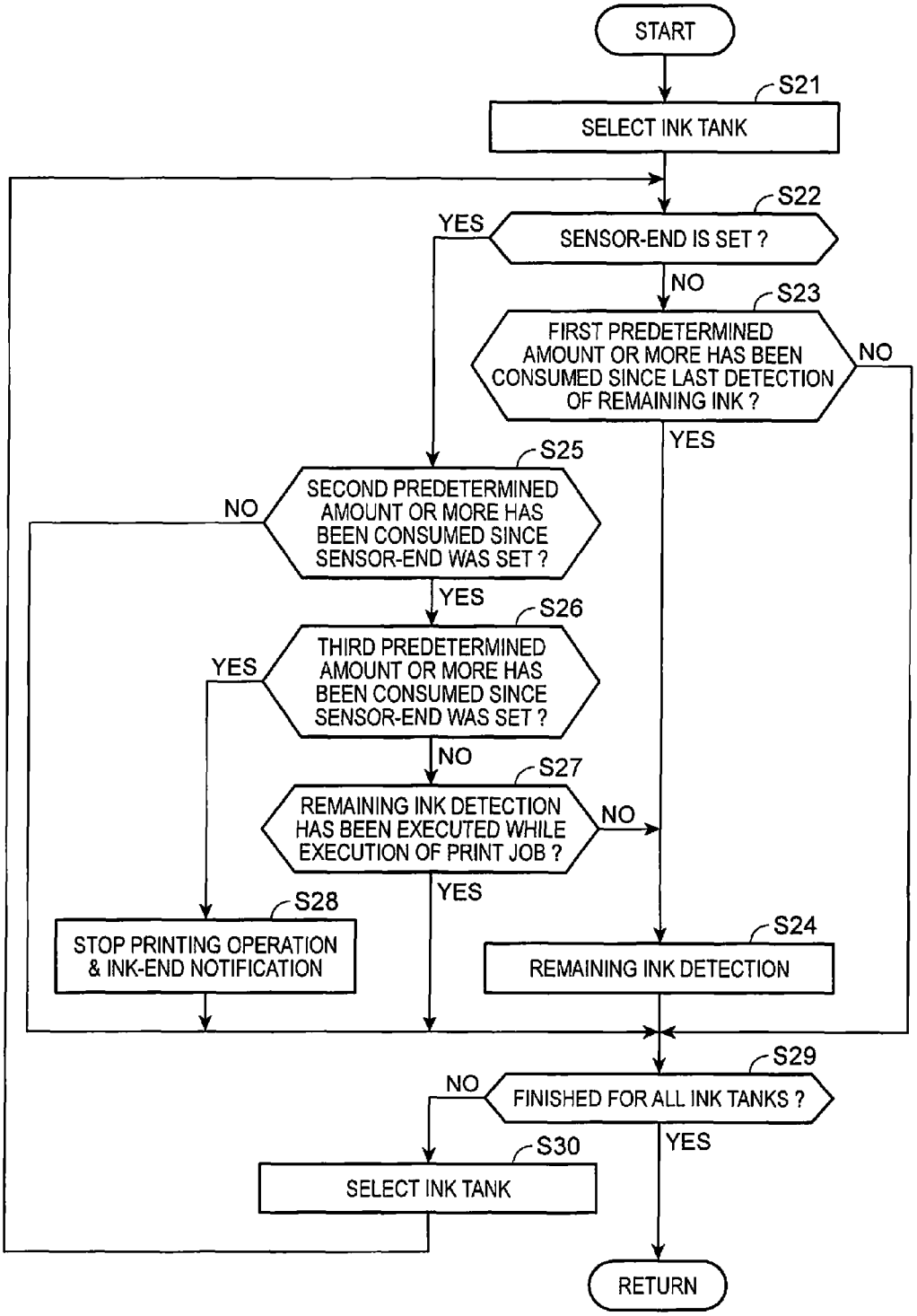
FIG. 7 is a flowchart showing a method for executing the remaining ink detection when a print job is being executed.
Figure 8:
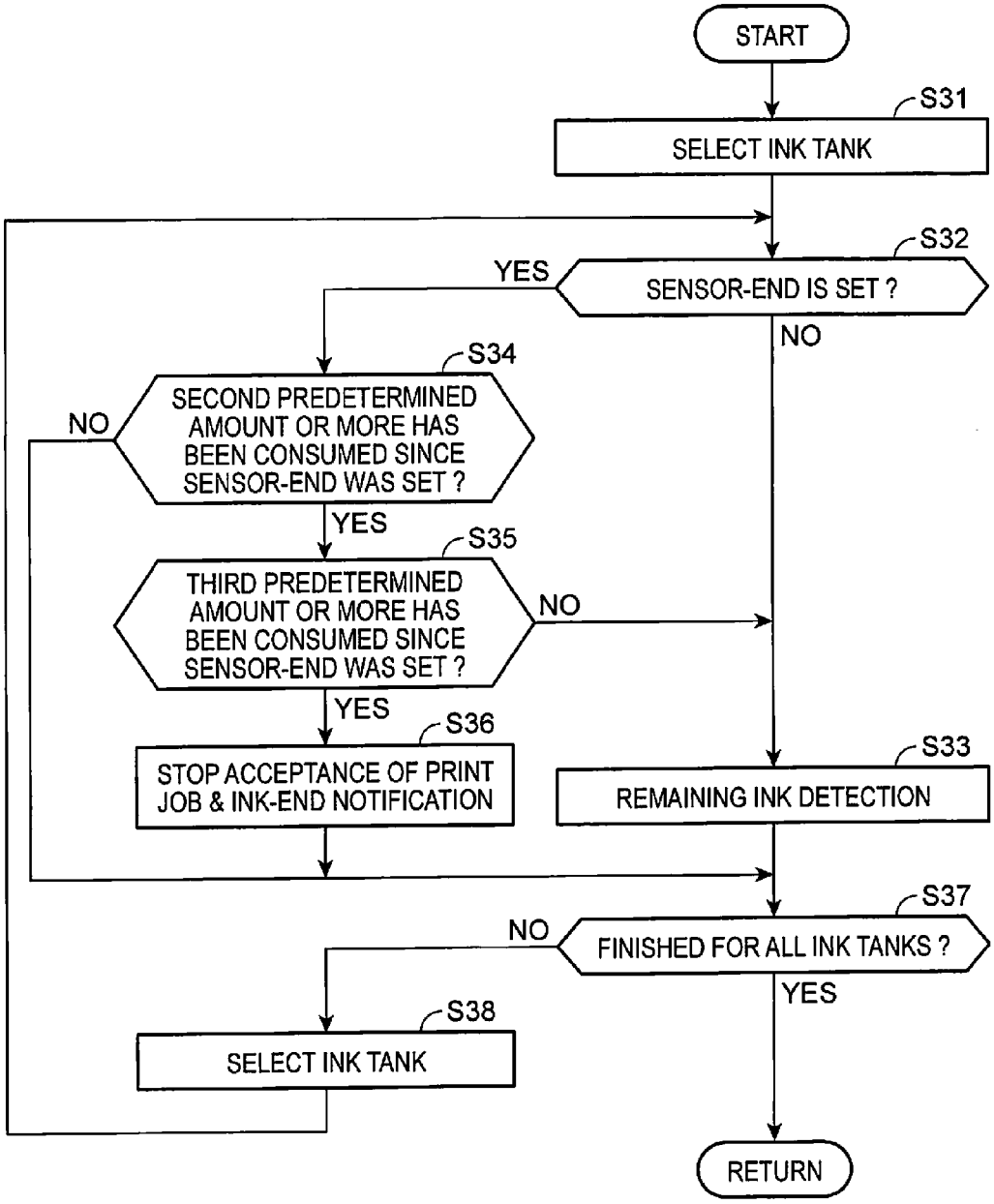
FIG. 8 is a flowchart showing a method for executing remaining ink detection when a print job is not being executed.

Next, a method for executing the remaining ink detection that is executed by the control unit 40 in the printer 110 according to this embodiment will be described with reference to FIGS. 6, 7, and 8. FIGS. 6 and 7 are flowcharts showing the method for executing the remaining ink detection when a print job is being executed. FIG. 8 is a flowchart showing the method for executing the remaining ink detection when a print job is not being executed. Note that, in the following description, the units provided in the control unit 40 in the printer 110 will be collectively referred to simply as the control unit 40.

In this embodiment, the remaining ink detection is executed at detection timings that are set respectively for the case where a print job is being executed and the case where a print job is not being performed.

When a print job is being executed, the remaining ink detection is executed only for the ink tank 11 in which the first predetermined amount of the ink IK or more has been consumed since it was determined in the previous remaining ink detection that the ink remained. The detection timings of executing the remaining ink detection when a print job is being executed are in a period from when a print job instruction is given until printing is started, when printing ends and the paper is discharged, and after regular flushing performed between pages that are being printed, for example.

In this embodiment, the remaining ink detection is not executed in a printing state where a voltage is applied to the print head 22 (see FIG. 2). Accordingly, when a print job is being executed, the remaining ink detection is executed in a non-printing state where the ink IK is not being ejected from the print head 22.

When a print job is not being executed, the remaining ink detection is executed for all ink tanks 11 (but excluding the ink tank 11 in which the second predetermined amount of the ink IK or more has not been consumed since the sensor-end flag 55 was set) at predetermined timings regardless of the consumption of the ink IK. The detection timings (predetermined timings) of executing the remaining ink detection when a print job is not being executed are when the power of the printer 110 is turned on, when in a standby state after a print job is executed, when cleaning the nozzles of the print head 22, and when the ink IK is supplied to the ink tank 11 for the first time when starting to use the printer 110, for example.

First, the method for executing the remaining ink detection when a print job is being executed will be described with reference to FIGS. 6 and 7. FIG. 6 illustrates the detection timings of detecting the amount of remaining ink (remaining ink detection) when executing a print job, and FIG. 7 illustrates the method for executing the remaining ink detection in each remaining ink amount detection processing.

As shown in FIG. 6, upon a print job instruction being given, the control unit 40 initially performs processing for feeding a print medium P from the paper cassette 114 into the printer 110 (step S01). Then, every time the carriage 20 scans once to perform printing on the print medium P for a single path (step S02), the control unit 40 determines whether or not to perform regular flushing (step S03). In this embodiment, if a nozzle exists that has not discharged the ink IK for a predetermined time, the regular flushing is performed for all nozzles of the print head 22.

In the case of performing the regular flushing (step S03: YES), the control unit 40 performs the regular flushing (step S04). After performing the regular flushing, the control unit 40 executes the remaining ink amount detection processing (step S05). On the other hand, in the case of not performing the regular flushing (step S03: NO), the control unit 40 advances the processing to step S06.

The remaining ink amount detection processing in step S05 is processing for checking whether or not to subject each of the four ink tanks 11 to the remaining ink detection, and executing the remaining ink detection on the ink tank 11 that is to be subjected to the processing. In the remaining ink amount detection processing, the control unit 40 selects any of the ink tank 11 (step S21), as shown in FIG. 7. Then, the control unit 40 determines whether or not the sensor-end flag 55 has been set for the selected ink tank 11 in the storage unit 50 (step S22).

If the sensor-end flag 55 has not been set in the storage unit 50 (step S22: NO), the control unit 40 references the latest consumption count 51 for the selected ink tank 11, and determines whether or not the first predetermined amount of the ink IK or more has been consumed since the previous remaining ink detection was executed and it was determined that the ink IK remained (step S23).

If the first predetermined amount of the ink IK or more has been consumed since the previous remaining ink detection was executed and it was determined that the ink IK remained (step S23: YES), the control unit 40 executes the remaining ink detection using the sensor 60 (step S24). On the other hand, if, in step S23, the first predetermined amount of the ink IK or more has not been consumed (step S23: NO), the control unit 40 does not execute the remaining ink detection in step S24 and advances the processing to step S29.

Although not shown in FIG. 7, if the processing proceeds to step S24 in a state where the sensor-end flag 55 has not been set (step S22: NO) and it is detected, as a result of executing the remaining ink detection using the sensor 60, that the ink IK is not present at the predetermined height in the ink tank 11, the control unit 40 makes the sensor-end determination for the selected ink tank 11. Then, the control unit 40 sets the sensor-end flag 55 in the storage unit 50 for the ink tank 11 for which the sensor-end determination is made, and advances the processing to step S27. If, in step S24, the sensor 60 detects that the ink IK is present at the predetermined height in the ink tank 11, the control unit 40 advances the processing to step S27 in this state.

Returning to step S22, if the sensor-end flag 55 is set in the storage unit 50 (step S22: YES), i.e., if it has already been determined that the ink IK was not present at the predetermined height, the control unit 40 references the post-detection consumption count 52 for the selected ink tank 11, and determines whether or not the second predetermined amount (predetermined value A) of the ink IK or more has been consumed since the sensor-end flag 55 was set (step S25).

If, in step S25, the consumption of the ink IK since the sensor-end flag 55 was set is smaller than the second predetermined amount (predetermined value A) (step S25: NO), the remaining ink detection in step S24 is not executed in order to avoid erroneous determination caused by movement of the liquid surface, air bubbles, or the like as mentioned above. Accordingly, the control unit 40 advances the processing to step S29.

If, in step S25, the consumption is larger than or equal to the second predetermined amount (predetermined value A) since the sensor-end flag 55 was set (step S25: YES), the control unit 40 advances the processing to step S26. In step S26, the control unit 40 references the post-detection consumption count 52, and determines whether or not the third predetermined amount (predetermined value B) of the ink IK or more has been consumed since the sensor-end flag 55 was set. If the consumption of the ink IK since the sensor-end flag 55 was set is smaller than the third predetermined amount (step S26: NO), the control unit 40 advances the processing to step S27.

In step S27, the control unit 40 determines whether or not the remaining ink detection has been executed while the current print job is being executed. If, in step S27, the remaining ink detection has not been executed while the current print job is being executed (step S27: NO), the control unit 40 executes the remaining ink detection using the sensor 60 (step S24).

On the other hand, if, in step S27, the remaining ink detection has already been executed while the current print job is being executed (step S27: YES), the control unit 40 does not execute the remaining ink detection and advances the processing to step S29. In other words, after the second predetermined amount (predetermined value A) of the ink IK or more has been consumed since the sensor-end flag 55 was set, the control unit 40 executes the remaining ink detection only once while the print job is being executed until the third predetermined amount (predetermined value B) of the ink IK or more is consumed.

When the ink consumption is larger than or equal to the second predetermined amount (predetermined value A) in step S25 for the first time, and the processing proceeds to step S26 and then transitions from step S27 to step S24, if it is detected, as a result of executing the remaining ink detection using the sensor 60, that the ink IK is not present at the predetermined height in the ink tank 11, the control unit 40 makes the ink-low determination for the selected ink tank 11. Then, the control unit 40 displays, on the display unit 47, an "ink-low notification" for notifying the user of a decrease in the amount of the remaining ink IK and prompting the user to supply the ink IK to the ink tank 11 for which the ink-low determination has been made, and advances the processing to step S29.

If, in step S26, the ink consumption is larger than or equal to the third predetermined amount (predetermined value B) (step S26: YES), the control unit 40 advances the processing to step S28 and stops the printing operation of the printer 110 (ink-end). Then, the control unit 40 displays, on the display unit 47, the "ink-end notification" for the ink tank 11 for which the ink-end determination has been made, and advances the processing to step S29.

When the third predetermined amount (predetermined value B) of the ink IK or more has been consumed in any of the ink tanks 11 and the processing proceeds to step S28, if the detection of the amount of remaining ink has ended for all ink tanks 11 (step S29: YES), the control unit 40 does not return to the flow in FIG. 6 but waits for the supply of the ink by the user and execution of the reset processing by the user.

Here, if the user supplies the ink IK and presses the reset button to execute the reset processing based on the ink-low notification or the ink-end notification, the control unit 40 executes the remaining ink detection using the sensor 60 for the selected ink tank 11 regardless of the consumption of the ink IK or the result of the previous remaining ink detection. The remaining ink detection is executed here in order to check that the user has supplied the ink IK.

If it is detected, as a result of this remaining ink detection, that the ink IK is present at the predetermined height, the control unit 40 restores the count values stored as the latest consumption count 51 and the post-detection consumption count 52 to the initial values thereof, and causes calculation of the ink consumption to be started. Also, if the sensor-end flag 55 is set in the storage unit 50, the control unit 40 deletes this sensor-end flag 55.

When the reset processing is executed by a manual operation of the user based on the ink-end notification and it is checked that the ink IK remains, the control unit 40 resumes the printing operation. Note that the user can execute the reset processing at any time by pressing the reset button. Upon the user executing the reset processing, the control unit 40 executes the remaining ink detection using the sensor 60 regardless of whether or not the detection timing has come.

On the other hand, when the ink consumption is larger than or equal to the second predetermined amount (predetermined value A) in step S25, the ink consumption is smaller than the third predetermined amount in step S26, the processing proceeds from step S27 to step S24, and the remaining ink detection is executed using the sensor 60, it is detected as a result of the remaining ink detection that the ink IK is present at the predetermined height in the ink tank 11 in some cases. These cases mean that the user has supplied the ink IK to the selected ink tank 11. Then, it is conceivable that the user has forgot to press the reset button and the reset processing has not been executed even though the user supplied the ink IK.

Accordingly, the control unit 40 executes "automatic reset processing" for the selected ink tank 11. That is to say, even though the user does not execute the reset processing with a manual operation for the selected ink tank 11, the control unit 40 deletes the sensor-end flag 55 stored in the storage unit 50, and restores the count value stored as the latest consumption count 51 and the count value stored as the post-detection consumption count 52 to the initial values thereof. The counting of the ink consumption for the selected ink tank 11 is thereby resumed. The control unit 40 then advances the processing to step S29.

Thus, in this embodiment, the remaining ink detection is repeatedly executed even after the sensor-end flag 55 is set, and it can thereby be detected that the user has supplied the ink IK. That is to say, if the user has supplied the ink IK, the control unit 40 recognizes that the ink IK has been supplied even when the user has forgot to press the reset button, and furthermore, executes the "automatic reset processing" if the reset processing has not been executed by a manual operation. It is thereby possible to suppress erroneous "ink-end" determination being made even though the user has supplied the ink IK and the ink IK remains.

Also, in this embodiment, if the second predetermined amount (predetermined value A) of the ink IK or more has been consumed since the sensor-end flag 55 was set (step S25: YES), the remaining ink detection is executed only once based on the determination in step S27 while a print job is being executed, until the third predetermined amount (predetermined value B) of the ink IK or more is consumed. If the second predetermined amount (predetermined value A) of the ink IK or more has been consumed and the "ink-low notification" is displayed, the user is highly likely to supply the ink IK at any time.

Here, it is conceivable that the user often supplies the ink IK when a print job is not being executed, and does not often supply the ink IK when a print job is being executed. Accordingly, the remaining ink detection is executed only once when a print job is being executed, and thus, it is possible to detect that the user has supplied the ink IK and suppress degradation in the throughput in printing while suppressing the risk of occurrence of idle ejection.

In step S29, it is determined whether the check on whether or not to execute the remaining ink detection has finished for all ink tanks 11. If the check on whether or not to execute the remaining ink detection has finished for all ink tanks 11 (step S29: YES), the control unit 40 advances the processing to step S06 shown in FIG. 6.

If the check on whether or not to execute the remaining ink detection has not finished for all ink tanks 11 (step S29: NO), the control unit 40 advances the processing to step S30, selects the next ink tank 11, and returns the processing to step S22. Thus, the control unit 40 sequentially checks whether or not to execute the remaining ink detection for all of the four ink tanks 11, and executes the remaining ink detection for the ink tank 11 that is to be subjected to the remaining ink detection.

Returning to FIG. 6, after executing step S05, the control unit 40 determines whether or not printing for a single page has finished (step S06). If printing for a single page has not finished (step S06: NO), the control unit 40 returns the processing to step S02.

On the other hand, if printing for a single page has finished (step S06: YES), the control unit 40 performs inter-page flushing (step S07). After performing the inter-page flushing, the control unit 40 executes the remaining ink amount detection processing (step S08). The remaining ink amount detection processing in step S08 is executed for the ink tank 11 that is to be subjected to the processing, as the remaining ink amount detection processing in step S05 is (see FIG. 7).

After the remaining ink amount detection processing in step S08 finishes, the control unit 40 performs processing for discharging the printed print medium P (step S09). After performing the processing for discharging the paper, the control unit 40 executes the remaining ink amount detection processing (step S10). The remaining ink amount detection processing in step S10 is also executed for the ink tank 11 that is to be subjected to the processing, as the remaining ink amount detection processing in step S05 is (see FIG. 7).

After the remaining ink amount detection processing in step S10 finishes, the control unit 40 determines whether or not the print job has finished (step S11). If the print job has finished (step S11: YES), the control unit 40 determines whether or not the next print job exists (step S12). If the next print job does not exist (step S12: NO), the control unit 40 executes the remaining ink amount detection processing (step S13) and ends the processing. Note that, in the remaining ink amount detection processing in step S13, the remaining ink detection is executed for all ink tanks 11.

On the other hand, if, in step S11, the print job has not finished (step S11: NO), or if, in step S12, the next print job exists (step S12: YES), the control unit 40 returns the processing to step S01 and repeats the processing in each step in FIG. 6.

Next, the method for executing the remaining ink detection when a print job is not being executed will be described with reference to FIG. 8. The processing in each step in FIG. 8 is executed for all ink tanks 11 regardless of the consumption of the ink IK when the power of the printer 110 is turned on, when in a standby state after executing a print job, when cleaning the nozzles of the print head 22, and when the ink IK is supplied to the ink tanks 11 for the first time when starting to use the printer 110, for example. However, the ink tank 11 is excluded in which the second predetermined amount of the ink IK or more has not been consumed since the sensor-end flag 55 was set.

As shown in FIG. 8, the control unit 40 selects any of the ink tanks 11 (step S31). Then, the control unit 40 determines whether or not the sensor-end flag 55 has been set for the selected ink tank 11 in the storage unit 50 (step S32). If the sensor-end flag 55 has not been set in the storage unit 50 (step S32: NO), the control unit 40 executes the remaining ink detection using the sensor 60 (step S33).

When the processing proceeds to step S33 in a state where the sensor-end flag 55 has not been set (step S32: NO), if it is detected, as a result of executing the remaining ink detection using the sensor 60, that the ink IK is not present at the predetermined height in the ink tank 11, the control unit 40 makes the sensor-end determination for the selected ink tank 11. Then, the control unit 40 sets the sensor-end flag 55 in the storage unit 50 for the ink tank 11 for which the sensor-end determination is made, and advances the processing to step S35. If, in step S33, the sensor 60 detects that the ink IK is present at the predetermined height in the ink tank 11, the control unit 40 advances the processing to step S37 in this state.

Returning to step S32, if the sensor-end flag 55 is set in the storage unit 50 (step S32: YES), the control unit 40 references the post-detection consumption count 52 for the selected ink tank 11, and determines whether or not the second predetermined amount (predetermined value A) of the ink IK or more has been consumed since the sensor-end flag 55 was set (step S34).

If the consumption of the ink IK since the sensor-end flag 55 was set is smaller than the second predetermined value (predetermine value A) (step S34: NO), the control unit 40 does not execute the remaining ink detection in step S33 and advances the processing to step S37 in order to avoid erroneous determination caused by movement of the liquid surface, air bubbles, or the like. On the other hand, if the second predetermined amount (predetermined value A) of the ink IK or more has been consumed since the sensor-end flag 55 was set (step S34: YES), the control unit 40 advances the processing to step S35.

In step S35, the control unit 40 references the post-detection consumption count 52, and determines whether or not the third predetermined amount (predetermined value B) of the ink IK or more has been consumed since the sensor-end flag 55 was set. If the third predetermined amount (predetermined value B) of the ink IK or more has been consumed (step S35: YES), the control unit 40 advances the processing to step S36.

In step S36, the control unit 40 stops the printing operation of the printer 110 (ink-end). Then, the control unit 40 displays, on the display unit 47, the "ink-end notification" for the ink tank 11 for which the ink-end determination has been made, and advances the processing to step S37. In this state, even if the user attempts to execute a print job, the printer 110 does not accept the print job and execute the printing operation.

In step S35, if the third predetermined amount of the ink IK or more has not been consumed (step S35: NO), the control unit 40 advances the processing to step S33 and executes the remaining ink detection using the sensor 60.

When the ink consumption is larger than or equal to the second predetermined amount (predetermined value A) for the first time in step S34, and the processing proceeds from step S35 to step S33 since the ink consumption is smaller than the third predetermined amount, if it is detected, as a result of executing the remaining ink detection using the sensor 60, that the ink IK is not present at the predetermined height in the ink tank 11, the control unit 40 makes the ink-low determination for the selected ink tank 11. Then, the control unit 40 displays, on the display unit 47, an "ink-low notification" for notifying the user of a decrease in the amount of the remaining ink IK and prompting the user to supply the ink IK to the ink tank 11 for which the ink-low determination has been made, and advances the processing to step S37.

When the ink consumption is larger than or equal to the third predetermined amount (predetermined value B) in step S35, and the processing proceeds to step S33, if it is detected, as a result of executing the remaining ink detection using the sensor 60, that the ink IK is present at the predetermined height in the ink tank 11, the control unit 40 executes the "automatic reset processing" for the selected ink tank 11. The control unit 40 thereby deletes the sensor-end flag 55 stored for the selected ink tank 11 in the storage unit 50, and restores the count value stored as the latest consumption count 51 and the count value stored as the post-detection consumption count 52 to the initial values thereof. The control unit 40 then advances the processing to step S37.

In step S37, it is determined whether the check on whether or not to execute the remaining ink detection has finished for all ink tanks 11. If the check on whether or not to execute the remaining ink detection has finished for all ink tanks 11 (step S37: YES), the control unit 40 ends the processing.

If the check on whether or not to execute the remaining ink detection has not finished for all ink tanks 11 (step S37: NO), the control unit 40 advances the processing to step S38, selects the next ink tank 11, and returns the processing to step S32. Thus, regarding the four ink tanks 11, the remaining ink detection is executed for the ink tanks 11 other than the ink tank 11 in which the second predetermined amount of the ink IK or more has not been consumed since the sensor-end flag 55 was set.

If the third predetermined amount (predetermined value B) of the ink IK or more has been consumed in any of the ink tanks 11 (step S35: YES) and the processing proceeds to step S36, the control unit 40 maintains a state of not accepting a print job until the user supplies the ink IK and executes the reset processing. When the reset processing is executed by a manual operation of the user based on the ink-end notification and it is checked that the ink IK remains by the remaining ink detection processing, the control unit 40 restores the printer 110 to a state of accepting a print job.

As described above, when a print job is being executed, the remaining ink detection is executed before performing printing for the next single path (step S05), before printing the next page, and before executing the next print job (steps S08 and S10). When a print job is not being executed as well, the remaining ink detection is executed when the power of the printer 110 is turned on, when in a standby state after executing a print job, and when cleaning the nozzles of the print head 22, for example. It is thereby possible to check whether the ink IK remains before printing, and accordingly, the risk of occurrence of idle ejection at the time of printing can be reliably suppressed.

While a print job is being executed, the remaining ink detection is executed for only the ink tank 11 in which the first predetermined amount of the ink IK or more has been consumed. For this reason, compared with the case of executing the remaining ink detection for all ink tanks 11, the total time for which a voltage is applied to the ink IK due to repeatedly executing the remaining ink detection can be suppressed, and accordingly, the influence thereof on the ink IK that may lead to deposition of the ink IK or the like can be suppressed.

Furthermore, in this embodiment, the remaining ink detection is executed when in a non-printing state where the ink IK is not being ejected from the print head 22. Accordingly, the influence thereof that may lead to degradation in the throughput when executing a print job can be suppressed by executing the remaining ink detection for only the ink tank 11 in which the first predetermined amount of the ink IK or more has been consumed.

The above embodiment describes only a mode of the invention, and can be arbitrarily modified and applied within the scope of the invention. For example, the following modifications are conceivable.

(Modification 1):

In the above embodiment, a configuration is employed in which the sensor 60 includes the pairs of electrodes 15 and 16, and it is determined based on a resistance value between each pair of electrodes 15 and 16 whether or not the ink IK is present at the predetermined height in the corresponding ink tank 11. However, the invention is not limited to this mode. For example, a configuration may be employed in which a photosensor including a light-emitting portion and a light-receiving portion is provided as the sensor, and it is determined whether or not the ink IK is present at the predetermined height in the ink tank 11, based on a difference in the intensity of the light emitted by the light-emitting portion and received by the light-receiving portion. Also, a configuration may be employed in which a weight sensor is provided as the sensor, and it is determined whether the ink IK is present at the predetermined height in the ink tank 11, based on a difference in the weight. The sensor is not limited to a sensor that determines whether or not the ink IK is present at the predetermined height in the ink tank 11, and need only be a sensor that determines whether the ink IK is present at a predetermined position in the ink tank 11, i.e., a sensor for detecting whether the amount of the remaining ink IK in the ink tank 11 is a predetermined amount.

(Modification 2):

In the above embodiment, when a print job is being executed, the remaining ink detection is executed when in a non-printing state where the ink IK is not being ejected from the print head 22. However, the remaining ink detection may also be executed in a printing state where the ink IK is being ejected from the print head 22.

(Modification 3):

The above embodiment has been described, taking, as an example, the printer system 100 that is a multifunction printer including the printer 110 serving as the printing apparatus, and the scanner 120. However, the invention is not limited to this mode. The printing apparatus may be a single function printer 110 that does not include the scanner 120.

(Modification 4):

The above embodiment has described an example in which the invention is applied to a printer and ink tanks. However, the invention is not limited to this mode. For example, the invention may also be used in a printing apparatus in which liquid other than ink is ejected or discharged, and is also applicable to a liquid vessel that contains such liquid.

The entire disclosure of Japanese Patent Application No. 2015-065933, filed on Mar. 27, 2015 is expressly incorporated herein by reference.

What is claimed is:

1. A printing apparatus to which a liquid vessel for containing liquid is fixed, and configured such that a user can supply the liquid to the liquid vessel, comprising:

a sensor for performing remaining liquid detection for checking whether or not the liquid is present at a predetermined position in the liquid vessel;

a control unit that executes the remaining liquid detection using the sensor;

a consumption calculation unit that calculates consumption of the liquid that is consumed from the liquid vessel; and a storage unit that updates and stores the consumption of the liquid calculated by the consumption calculation unit, wherein, when a print job is being executed, the control unit executes the remaining liquid detection after a first predetermined amount of the liquid is consumed.

2. The printing apparatus according to claim 1,
wherein the control unit executes the remaining liquid detection when in a non-printing state while the print job is being executed.

3. The printing apparatus according to claim 1,
wherein the sensor includes a pair of conductive members, and detects whether or not the liquid remains based on a resistance value between the pair of conductive members.

4. The printing apparatus according to claim 1,
wherein the storage unit has an area for storing a sensor-end flag that is set when the remaining liquid detection is executed and it is detected that the liquid does not remain, and
the control unit stops execution of the remaining liquid detection if the sensor-end flag is stored in the storage unit.

5. The printing apparatus according to claim 4,
wherein a plurality of the liquid vessels are provided,
the sensor is configured to be able to individually detect whether or not the liquid remains in the plurality of liquid vessels,
the storage unit has an area for individually storing the sensor-end flag for the plurality of liquid vessels, and
the control unit stops execution of the remaining liquid detection for a liquid vessel for which the sensor-end flag is stored in the storage unit among the plurality of liquid vessels.

6. The printing apparatus according to claim 5,
wherein, when the print job is not being executed, the control unit executes the remaining liquid detection at a predetermined timing for a liquid vessel for which the storage unit does not store the sensor-end flag among the plurality of liquid vessels.

7. The printing apparatus according to claim 5,
wherein the sensor has an AC voltage generation circuit that generates an AC voltage, a detection unit that detects whether or not the liquid remains, the pair of conductive members that are separately disposed in each of the plurality of liquid vessels, and a selection circuit that selectively connects the pair of conductive members disposed in one of the plurality of liquid vessels to the AC voltage generation circuit and the detection unit, and
the control unit transmits, to the selection circuit, a selection signal for selecting a liquid vessel for which the remaining liquid detection is to be executed from among the plurality of liquid vessels, and transmits an instruction signal for giving an instruction to generate an AC voltage to the AC voltage generation circuit.

8. The printing apparatus according to claim 5,
wherein, regarding at least two of the plurality of liquid vessels, the amounts of the remaining liquid therein at the time when the remaining liquid detection is executed and it is detected that the liquid does not remain are different from each other, and
the first predetermined amount for each of the two of the liquid vessels is set to a different value.

9. The printing apparatus according to claim 4,
wherein, if the sensor-end flag is stored in the storage unit, the control unit executes the remaining liquid detection after a second consumption of the liquid becomes larger than or equal to a second predetermined amount, the second consumption of the liquid being calculated starting from the time when it is detected for the last time that the liquid remains before the remaining liquid detection is executed and it is detected that the liquid does not remain.

10. The printing apparatus according to claim 9,
wherein, after executing the remaining liquid detection and detecting that the liquid does not remain after the second consumption of the liquid becomes larger than or equal to the second predetermined amount, the control unit executes the remaining liquid detection once per print job when the print job is being executed, and executes the remaining liquid detection at a predetermined timing when the print job is not being executed.

11. The printing apparatus according to claim 9,
wherein, when the remaining liquid detection is executed and it is detected that the liquid remains after the second consumption of the liquid becomes larger than or equal to the second predetermined amount, the control unit deletes the sensor-end flag stored in the storage unit.

12. The printing apparatus according to claim 9,
wherein, after the remaining liquid detection is executed and it is detected that the liquid does not remain after the second consumption of the liquid becomes larger than or equal to the second predetermined amount, the control unit stops a printing operation after second consumption of the liquid becomes larger than or equal to a third predetermined amount that is larger than the second predetermined amount.

13. The printing apparatus according to claim 12,
wherein the storage unit updates and stores, for each path, the consumption of the liquid calculated by the consumption calculation unit while the print job is being executed, and
the control unit uses the consumption of the liquid stored in the storage unit for comparison with the first predetermined amount, the second predetermined amount, and the third predetermined amount.

* * * * *